US008221153B2

(12) United States Patent
Svelnis et al.

(10) Patent No.: US 8,221,153 B2
(45) Date of Patent: Jul. 17, 2012

(54) TOOL-RELEASABLE SOLAR POWER CONNECTOR

(75) Inventors: Christine M. Svelnis, Boylston, MA (US); Jason Nicholson, Westborough, MA (US); Jeffrey S. Burkhardt, Brookline, NH (US); Brian F. Davies, Acton, MA (US)

(73) Assignee: Anderson Power Products, Inc., Sterling, MA (US)

( * ) Notice: Subject to any disclaimer, the term of this patent is extended or adjusted under 35 U.S.C. 154(b) by 0 days.

(21) Appl. No.: 13/077,061

(22) Filed: Mar. 31, 2011

(65) Prior Publication Data

US 2011/0244710 A1 Oct. 6, 2011

Related U.S. Application Data

(60) Provisional application No. 61/320,788, filed on Apr. 5, 2010, provisional application No. 61/381,712, filed on Sep. 10, 2010.

(51) Int. Cl.
*H01R 13/62* (2006.01)

(52) U.S. Cl. ..... 439/372

(58) Field of Classification Search ..... 439/372, 439/157

See application file for complete search history.

(56) References Cited

U.S. PATENT DOCUMENTS

| | | | | |
|---|---|---|---|---|
| D324,206 | S | 2/1992 | Sueyoshi et al. | |
| 6,142,787 | A * | 11/2000 | Ikesugi | 439/15 |
| 6,203,355 | B1 * | 3/2001 | Neblett et al. | 439/372 |
| 6,241,540 | B1 * | 6/2001 | Tokuwa | 439/157 |
| 6,325,647 | B1 * | 12/2001 | May et al. | 439/157 |
| 6,494,729 | B1 * | 12/2002 | Stathopoulos et al. | 439/160 |
| 6,655,971 | B2 * | 12/2003 | Maegawa | 439/157 |
| 6,814,606 | B2 * | 11/2004 | Kobayashi | 439/372 |
| 7,393,234 | B1 * | 7/2008 | Chien et al. | 439/372 |
| D613,246 | S | 4/2010 | Muecke et al. | |
| D620,888 | S | 8/2010 | Svelnis et al. | |
| D621,355 | S | 8/2010 | Svelnis | |
| D627,733 | S | 11/2010 | Stutz | |
| 2006/0276071 | A1 | 12/2006 | Rossi | |

* cited by examiner

*Primary Examiner* — Gary F. Paumen
(74) *Attorney, Agent, or Firm* — Maine Cernota & Rardin

(57) ABSTRACT

An electrical connector housing system includes a plug housing, a receptacle housing, and a latching mechanism. The latching mechanism pivots on pivot posts on one housing and hooks to latching posts on the other housing, thereby securing the mated housings together. Catches on the latch mechanism engage with tabs near the latching posts when the latching mechanism is latched. The catches must be released using a screwdriver or similar tool before opening the latching mechanism and separating the mated housings. A protective barrier can be included to block direct access to the engaged catches and tabs. The housings include overlapping shells which exclude water and dirt, and the latching mechanism at least partially covers and further protects the shells when closed. In embodiments, a retaining mechanism automatically holds the latch open against gravity, facilitating connection and release of the housings with one hand and/or while wearing gloves.

14 Claims, 38 Drawing Sheets

TOP VIEW

LEFT VIEW

BOTTOM VIEW

RIGHT VIEW

FRONT VIEW

BACK VIEW

TOP VIEW

LEFT VIEW

BOTTOM VIEW

RIGHT VIEW

FRONT VIEW

BACK VIEW

TOP VIEW

RIGHT VIEW

BOTTOM VIEW

LEFT VIEW

FRONT VIEW

BACK VIEW

FRONT VIEW

LEFT VIEW

RIGHT VIEW

BACK VIEW

BOTTOM VIEW

TOOL-RELEASABLE SOLAR POWER CONNECTOR

RELATED APPLICATIONS

This application claims the benefit of U.S. Provisional Applications No. 61/320,788, filed Apr. 5, 2010, and No. 61/381,712, filed Sep. 10, 2010. Both of these applications are herein incorporated by reference in their entirety for all purposes.

FIELD OF THE INVENTION

The invention relates to electrical connectors, and more particularly, to electrical connectors that meet applicable standards for the solar power industry.

BACKGROUND OF THE INVENTION

Single-contact and multiple-contact electrical connector systems are widely used for many household and industrial applications. Typically, such connector systems include a plug and a compatible receptacle, each of which includes or can accept installation of one or more electrical contacts which are interconnected when the plug is mated with the receptacle. Plug and receptacle housings are provided so as to isolate the electrical contacts from each other and from the environment, position them in alignment with each other, and maintain the contacts in secure connection with each other when the connectors are mated. The contacts can be integral with the housings, or they can be installable into the housings, so that a given housing system can accept a plurality of types and arrangements of contacts. Often, a latching mechanism is included with the housings so as to avoid inadvertent separation of the plug from the receptacle.

Electrical connectors are subject to various standards and requirements, depending on their intended usages. In particular, there are many standards and practical considerations that apply specifically, if not uniquely, to connectors used in the solar power industry, since solar power connectors are often located on rooftops, on towers, or in other locations with limited access, and are frequently exposed to sunlight, debris, rain, and other outdoor environmental conditions. It is not uncommon, for example, for a worker to be wearing gloves and/or to have one hand otherwise occupied while attempting to release a pair of mated solar power electrical connector. However, standards are currently pending that will require mated solar power connectors to be releasable from each other only through the use of a tool, thereby making it difficult to release such connectors using only one hand and/or while wearing gloves.

What is needed, therefore, is an electrical power connector housing system that requires a tool for release of mated connectors, inhibits contamination by debris and rain while connected, and can be released using one hand and/or while wearing gloves.

SUMMARY OF THE INVENTION

A versatile electrical connector housing system is claimed that provides secure, latched connection of contacts, requires use of a screwdriver or similar implement for release, and inhibits contamination by water and debris when latched. Embodiments also facilitate release of the connectors with one hand and/or when wearing gloves.

The claimed connector housing system includes a plug housing and a compatible receptacle housing, one of which includes a pair of latch pivots extending outward from opposing walls, and the other of which includes a pair of latch posts extending out from opposing walls. For the sake of convenience, the invention will be described herein as having the latch pivots located on the receptacle housing, and the latch posts being on the plug housing. However, it should be understood that in some embodiments of the present invention the latch pivots are located on the plug housing, and the latch posts are located on the receptacle housing.

The claimed connector housing system further includes a latch mechanism which is rotatably mountable on the latch pivots and includes a pair of hooks which can engage with the opposing pair of latch posts when the plug housing and the receptacle housing are mated. Proximal to each hook of the latch mechanism is a catch that mates with a compatible catch tab included proximal to the corresponding latch post when the hook is engaged with the post, thereby requiring that a screwdriver or similar implement be used to release the catches from the catch tabs so as to disengage the hooks from the posts, rotate the latch mechanism out of the way, and separate the connector housings. In various embodiments, the catches are attached to the latch mechanism by living hinges.

Protective latching barriers are provided in some embodiments which block direct access to the latching regions where the latches engage with the latch posts and the catches engage with the catch tabs. The latching barriers thereby further inhibit release of the catches from the catch tabs without use of a suitable tool to circumvent the barriers.

When the latch mechanism is engaged, it covers the juncture between the two housings, thereby inhibiting entry of water and debris into the connector. In certain embodiments, when the latch is rotated to its open orientation, a latch retaining mechanism automatically captures the latch and holds it in its open position.

In some embodiments, one or more electrical contact is/are permanently attached to or integrated with each of the connector housings. In other embodiments, each of the connector housings can accept any of a variety of insertable contacts of various sizes and configurations.

In certain embodiments, some or all of the connector housing system is made from a plastic that is UL certified for UV exposure, and in some embodiments the connector housing system is configured to pass a drop test from 1 meter at −40 degrees C.

The present invention is a connector housing system which includes a receptacle housing having a receptacle shell and being configured for housing at least one electrical contact and a plug housing having a plug shell, the plug housing being adapted for housing at least one electrical contact and for mating with the receptacle housing in a mating direction, the plug shell being adapted for overlapping the receptacle shell when the plug housing is mated with the receptacle housing, the overlapping shells thereby forming a barrier which inhibits penetration of water and debris to the electrical contacts.

The invention further includes a pair of latch pivots extending outward in opposing directions from one of the receptacle housing and the plug housing, the latch pivots extending along an axis perpendicular to the mating direction, and a pair of latch posts extending outward in opposing directions from the other of the receptacle housing and the plug housing and configured so as to be aligned with the latch pivots when the receptacle housing is mated with the plug housing.

The invention also includes a latch mechanism having a pair of opposing pivot holes and a pair of opposing latch hooks, the pair of opposing pivot holes being rotatably mountable on the pair of latch pivots so as to enable the latch mechanism to rotate between a latched orientation and an open orientation, the latch hooks being configured for hooking attachment to the latch posts when the latch is in the latched orientation, the latch being configured so as to cover at least a portion of the overlapping shells of the receptacle housing and the plug housing and inhibit entry therein of debris and water when the latch mechanism is in the latched orientation, a pair of catch tabs proximal to the pair of latch posts, and a pair of catches proximal to the pair of latch hooks and adapted to automatically engage with the catch tabs when the latch mechanism is in the latched orientation, release of the catches from the catch tabs being required before the latch mechanism can be rotated from the latched orientation to the open orientation, whereby the catches can be released from the catch tabs only by use of a tool, and not by an unaided hand.

Embodiments of the present invention further include a latch retaining mechanism configured so as to automatically capture the latch mechanism when the latch mechanism is rotated to the open orientation, and to retain the latch mechanism in the open orientation against gravitational disengagement until the latch is dislodged therefrom by an externally applied force. In some of these embodiments the latch retaining mechanism includes a retaining stop which protrudes from the plug housing and a retaining flap which extends from the latch, the retaining stop and the retaining flap being configured so as to cause the retaining flap to engage with the retaining stop when the latch mechanism is attached to the latch pivots and rotated to the open orientation.

In various embodiments the catches can be released from the catch tabs by use of a screwdriver. In some embodiments at least one of the receptacle housing and the plug housing includes at least one permanently mounted electrical contact. In other embodiments at least one of the receptacle housing and the plug housing is configured to accept at least one insertable electrical contact.

In certain embodiments the catches are attached to the latch mechanism by living hinges. Some of these embodiments further include a pair of catch stops adapted for limiting the ranges of movement of the living hinges.

In various embodiments the pair of opposing pivot holes of the latch mechanism are mountable on the pair of latch pivots and on the pair of latch posts, the latch hooks can be engaged with either of the pair of latch pivots and the pair of latch posts, and a pair of catch tabs is provided on each of the plug housing and the receptacle housing, thereby enabling the latch mechanism to be attached to either the receptacle housing or the plug housing and hooked to the other of the receptacle housing and the plug housing, according to a preference of a user of the connector housing system. In some of these embodiments a latch retaining mechanism is able to retain the latch in the open orientation when the latch is attached to the receptacle housing, and a latch retaining mechanism is able to retain the latch in the open orientation when the latch is attached to the plug housing.

In some embodiments at least one of the receptacle housing and the plug housing is configured for mounting to a threaded conduit. In other embodiments at least one element of the connector housing system is made from plastic that is UL outdoor rated for ultraviolet exposure.

In certain embodiments at least one element of the connector housing system is constructed so as to pass a drop-test of 1 meter at minus 40 degrees C. And various embodiments further include a pair of protective latching barriers which block direct access to the catches and the catch tabs when the catches are engaged with the catch tabs and the latch mechanism is in the latched orientation.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIGS. 1K through 1P are top, left, bottom, right, front, and rear views respectively of the plug housing of FIG. 1I;

DETAILED DESCRIPTION

The present invention is a versatile electrical connector housing system which provides secure, latched connection of contacts, requires use of a screwdriver or similar implement for release of the connectors, and inhibits contamination of the contacts by water and debris when latched. Some embodiments facilitate release of the connectors with one hand and/or when wearing gloves. In various embodiments, at least one element of the claimed electrical connector housing system is made from plastic that is UL outdoor rated for UV and/or designed to pass a drop-test of 1 meter at minus 40 degrees C.

Figure 1A:
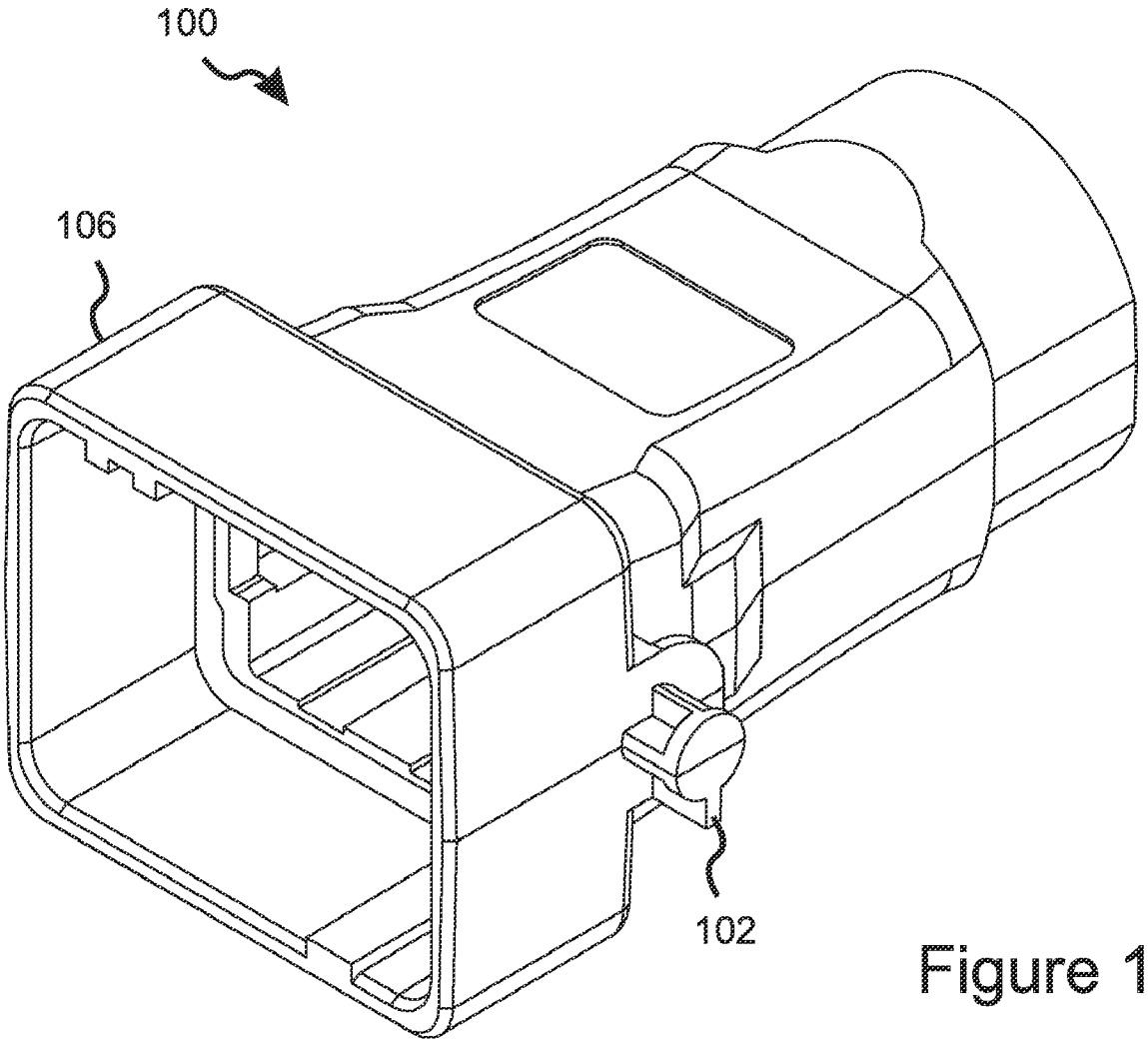
FIG. 1A is a perspective view of a plug housing of a preferred embodiment, the receptacle housing being configured for direct attachment to a cable.
Figure 1B:
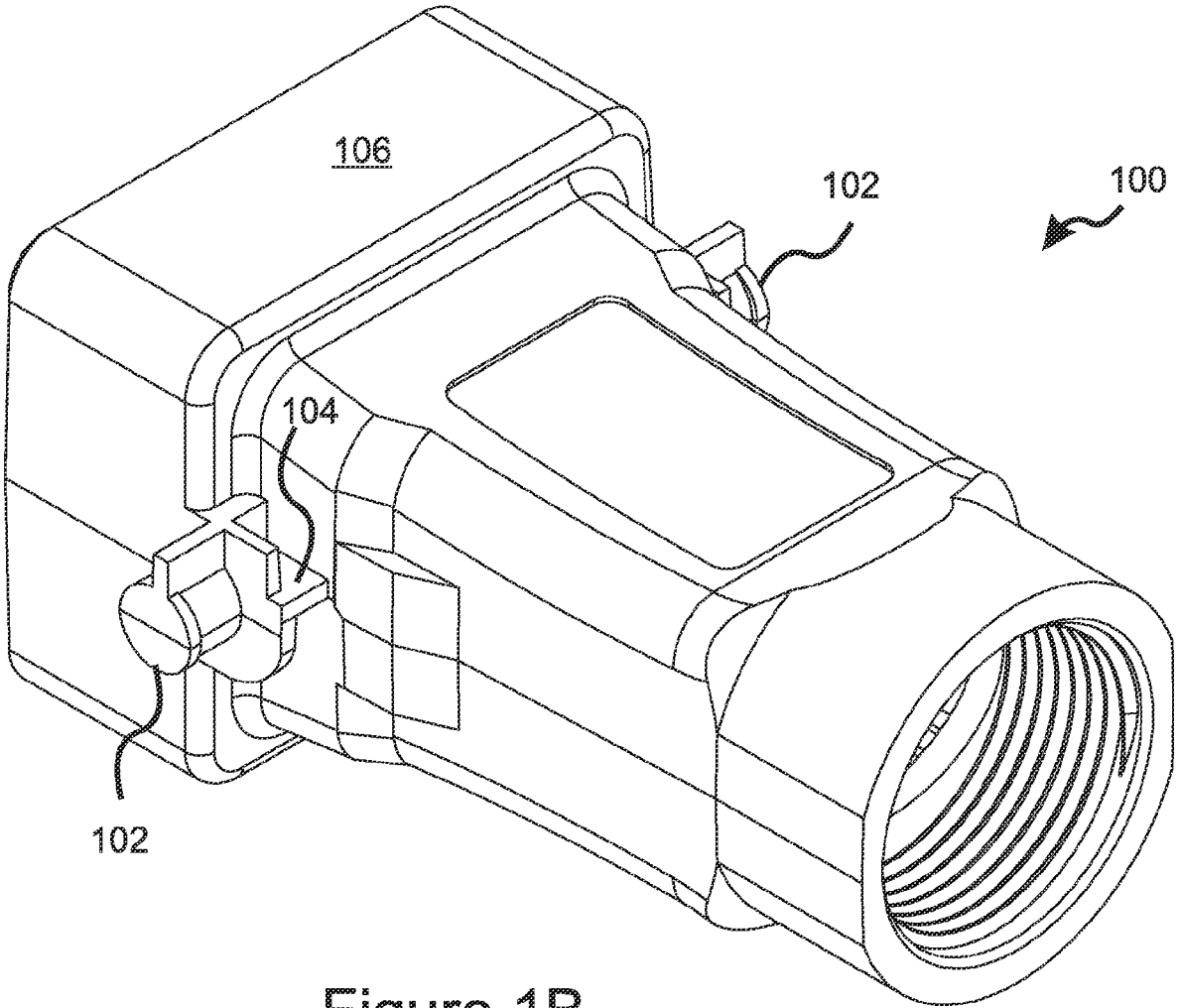
FIG. 1B is a reverse perspective view of the plug housing of FIG. 1A.
Figure 1C:
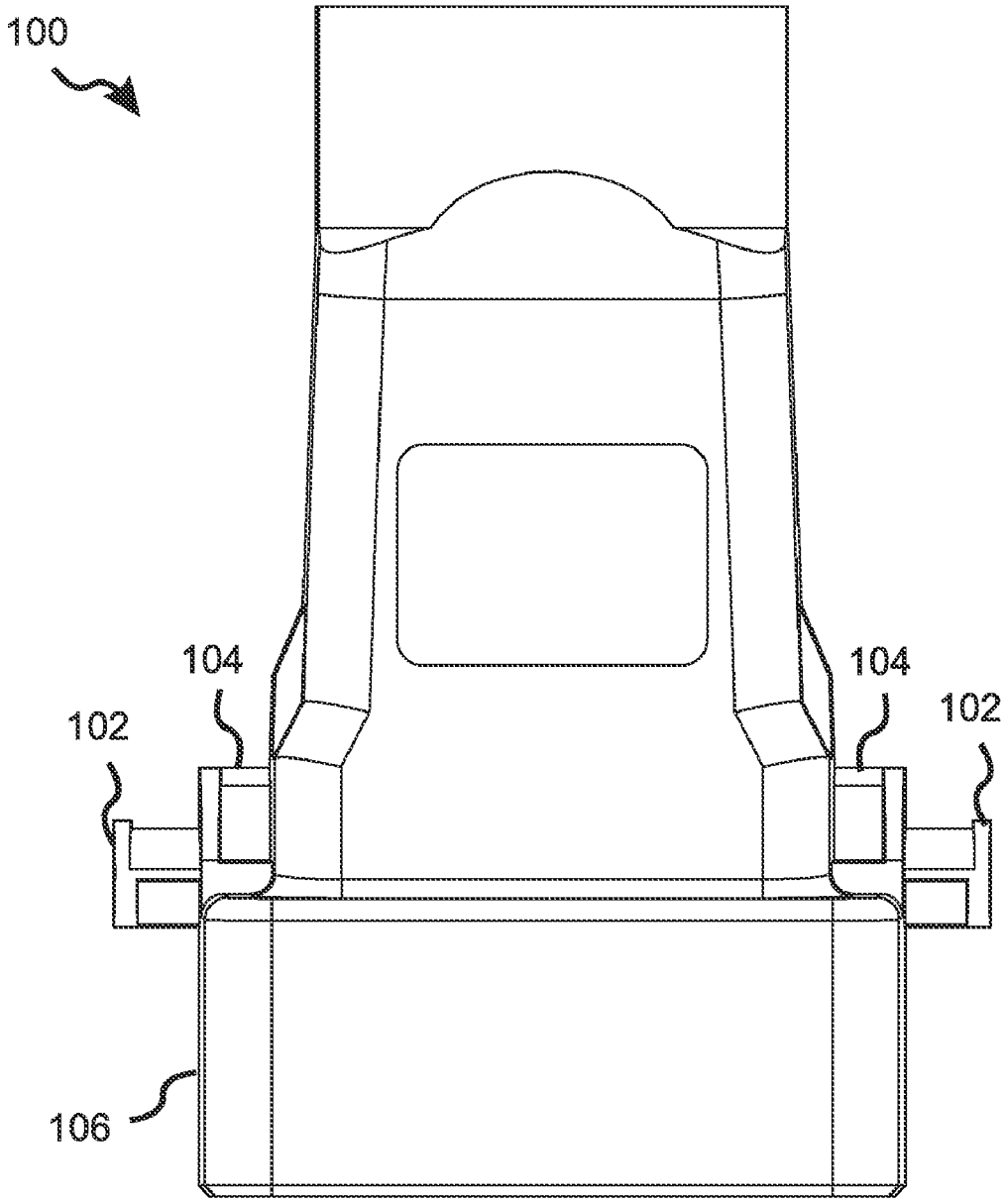
FIGS. 1C through 1H are top, left, bottom, right, front, and rear views respectively of the plug housing of FIG. 1A.
Figure 1D:
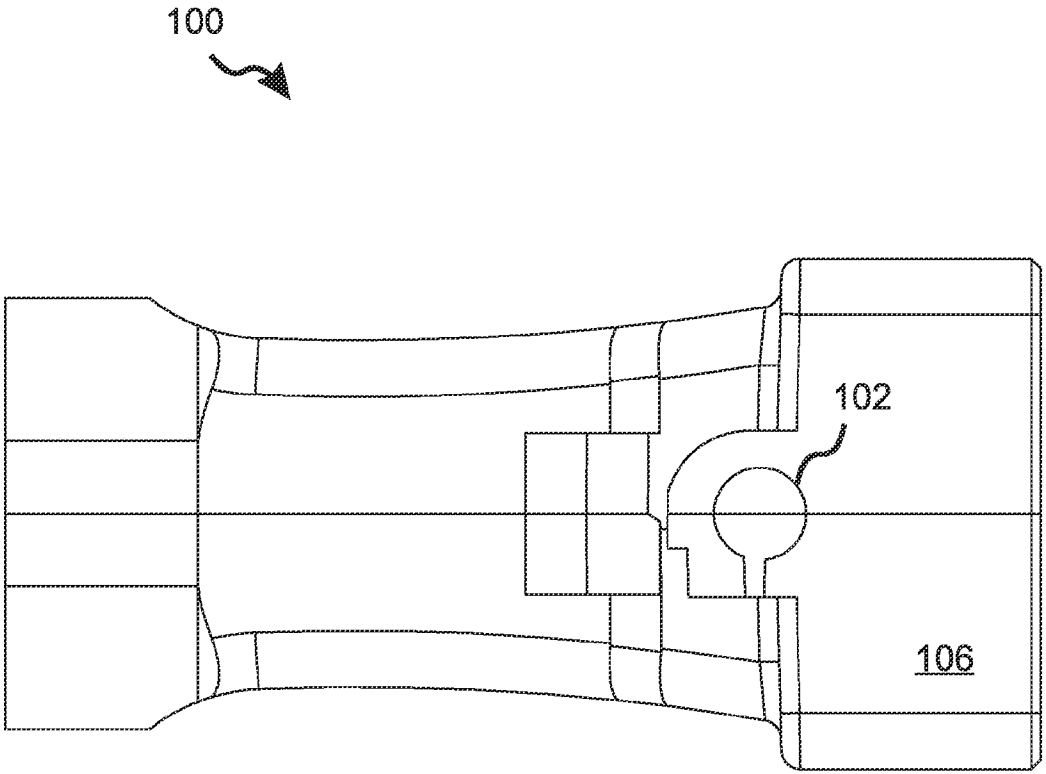
Figure 1E:
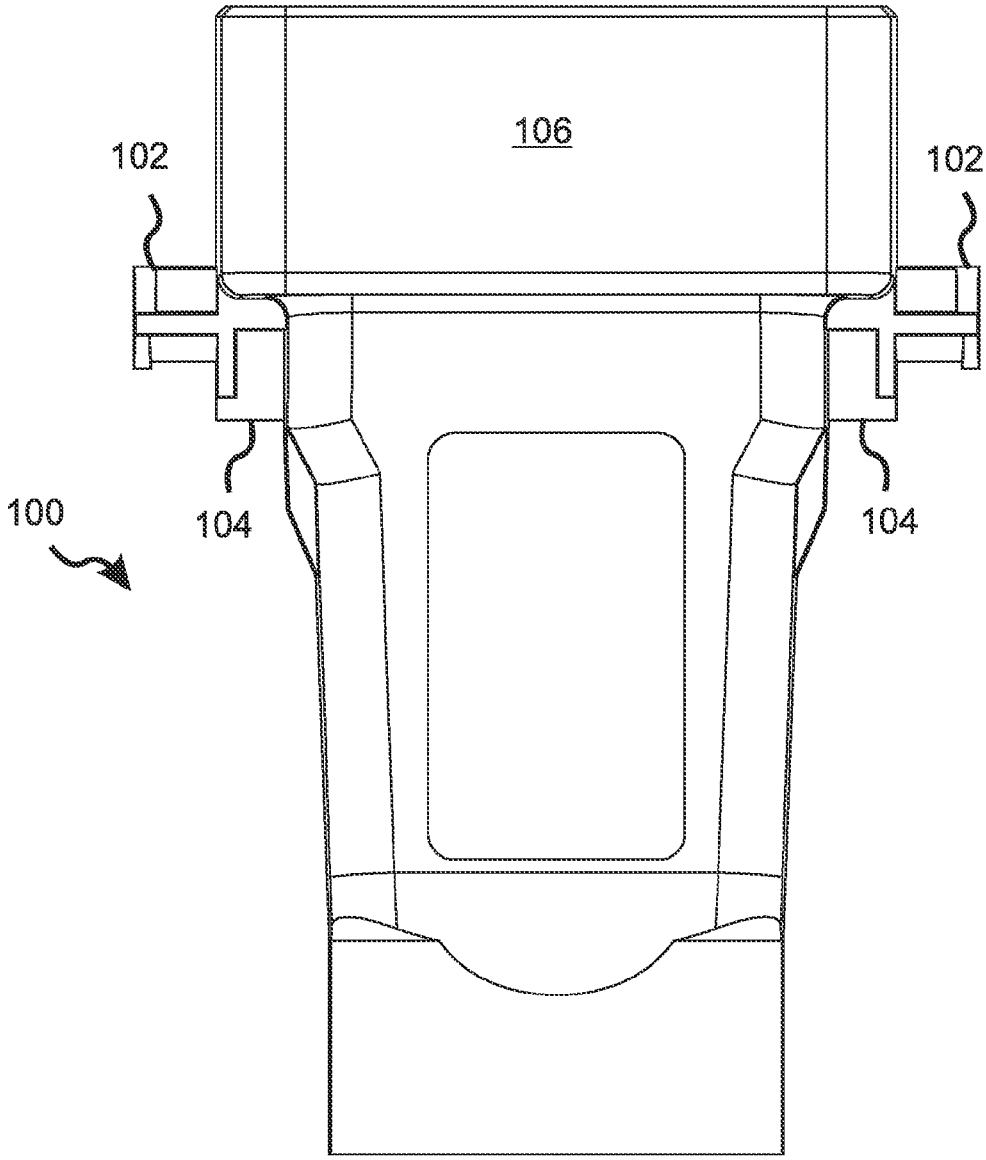
Figure 1F:
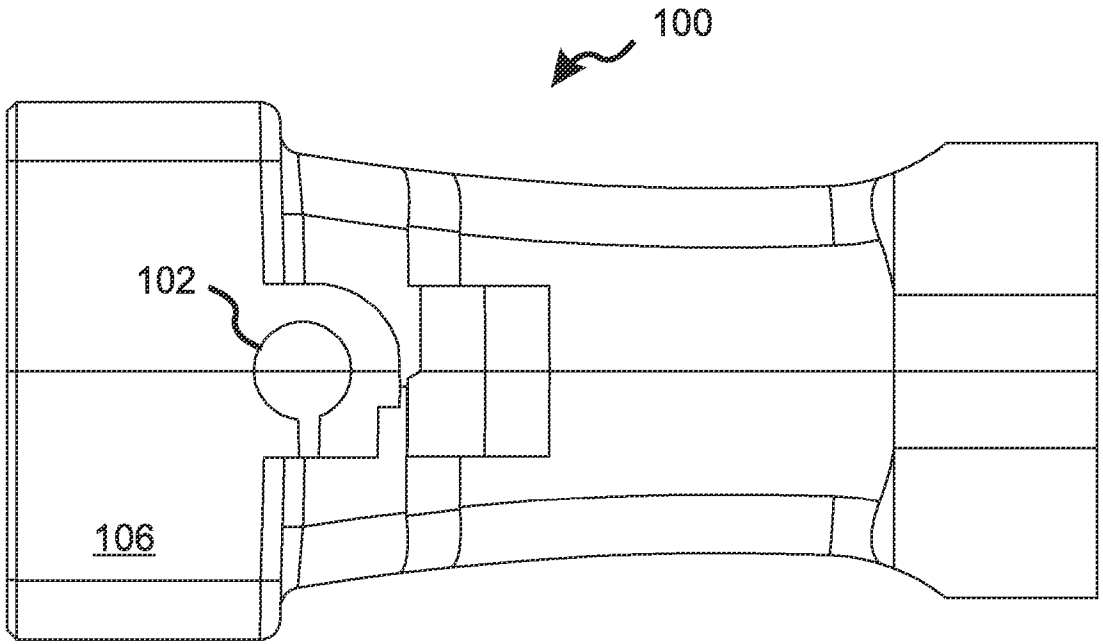
Figure 1G:
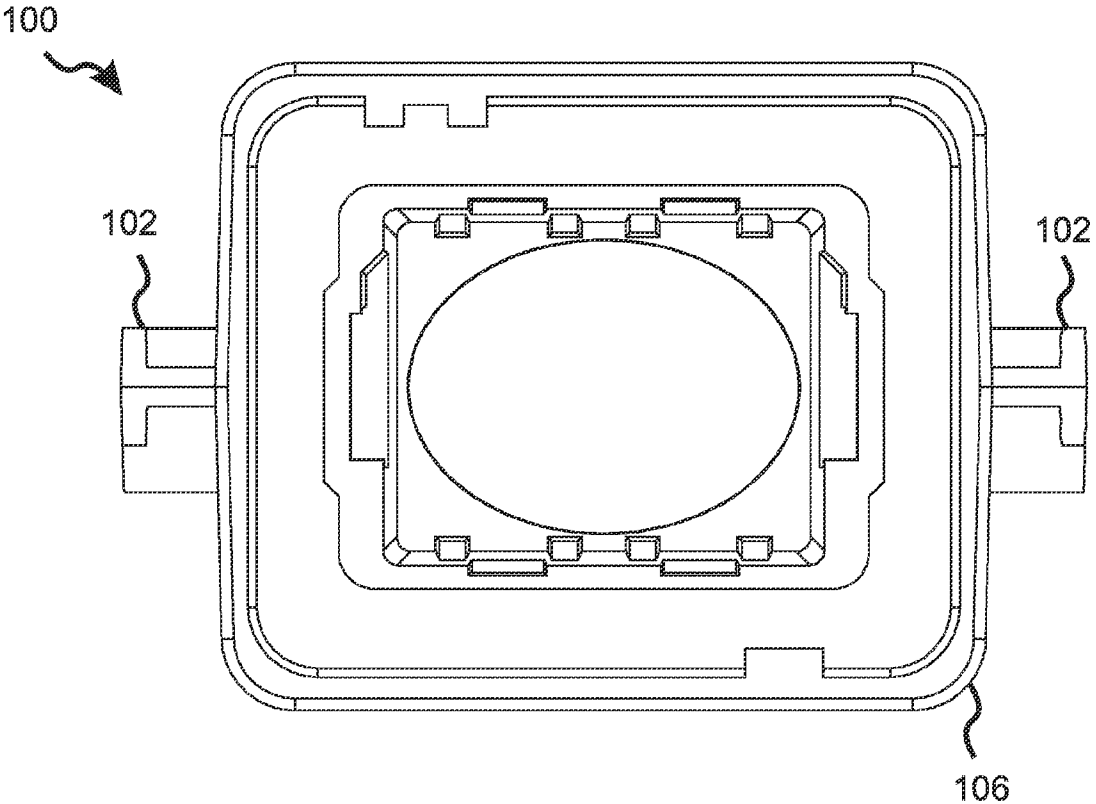
Figure 1H:
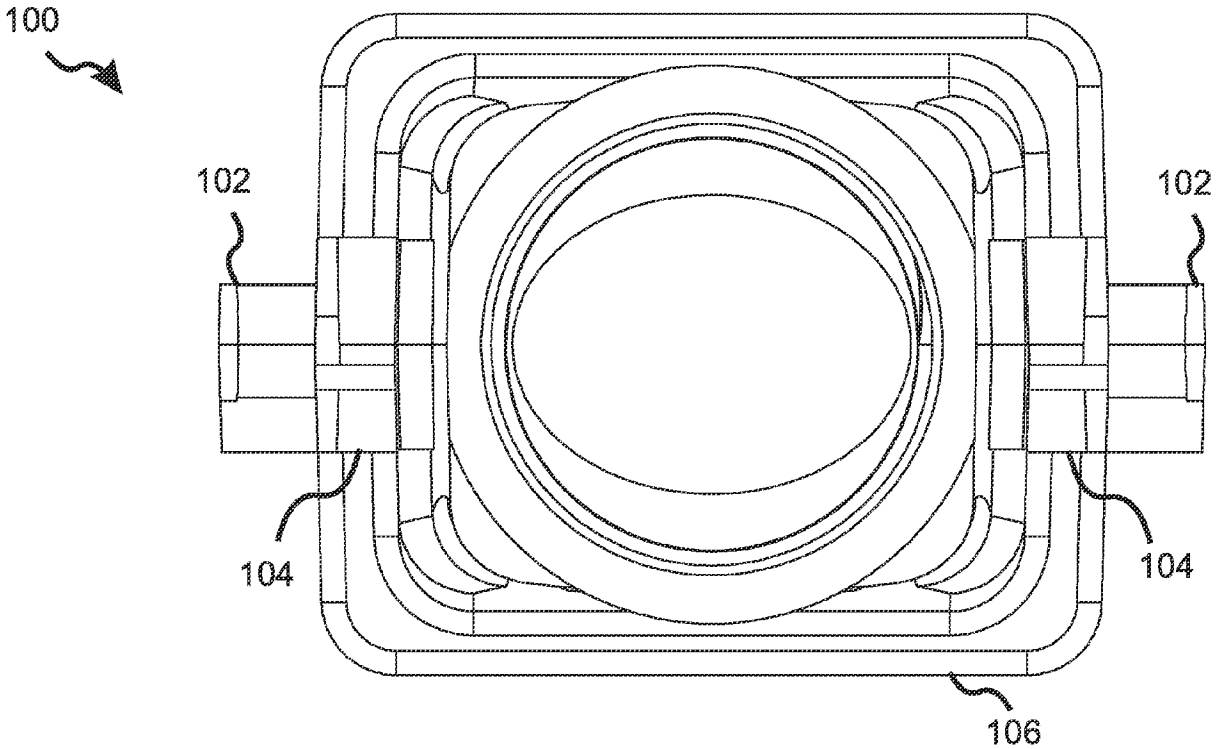
Figure 2A:
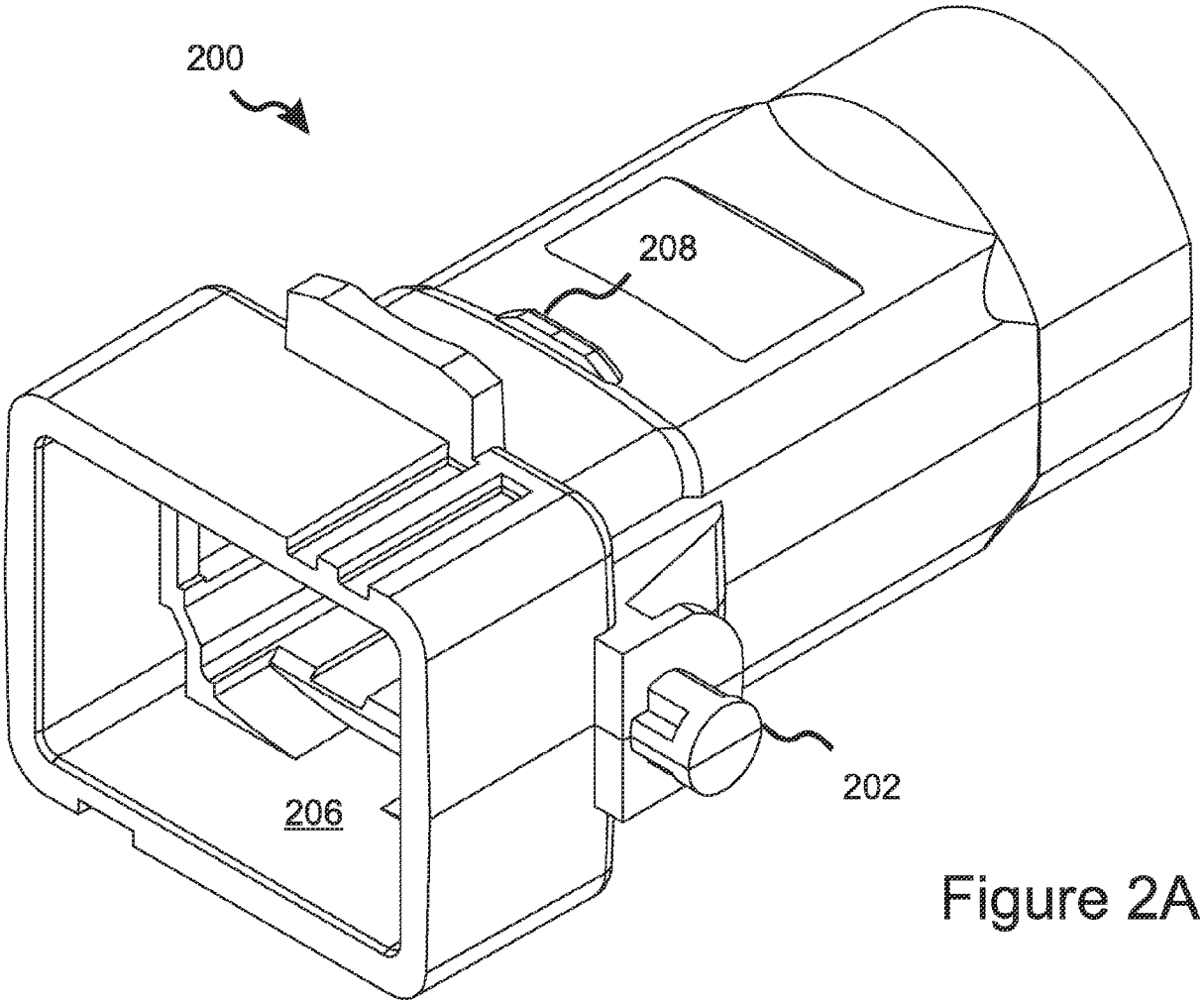
FIG. 2A is a perspective view of a receptacle housing of a preferred embodiment, the receptacle housing being configured for direct attachment to a cable.

With reference to FIG. 1A, the claimed electrical connector housing system includes a plug housing 100 which can be mated with a compatible receptacle housing (200 in FIG. 2A). The plug housing 100 includes a pair of latch posts 102 and an overlapping shell 106 into which a compatible shell (206 in FIG. 2A) included with the receptacle housing 200 is insertable. With reference to FIG. 1B, catch tabs 104 are located proximal to the latch posts 102, and are adapted for engaging with the catches 312 of the latching mechanism 300, as described in more detail with reference to FIG. 3A below.

FIGS. 1C through 1H are top, left, front, right, bottom, and rear views respectively of the embodiment of FIG. 1A.

Figure 1I:
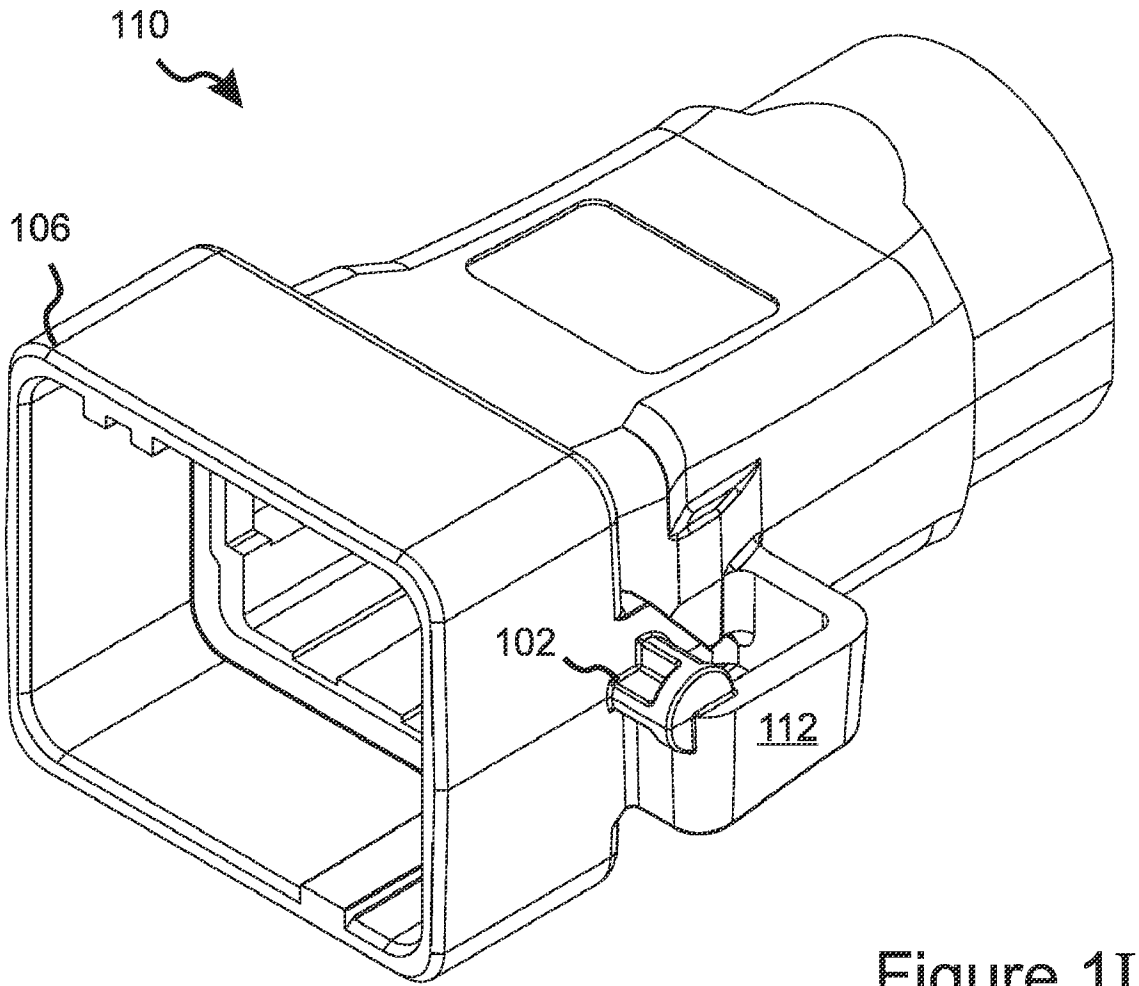
FIG. 1I is a perspective view of a plug housing of a preferred embodiment which includes protective latching barriers surrounding the latching regions of the plug housing, the plug housing being configured for direct attachment to a cable.
Figure 1J:
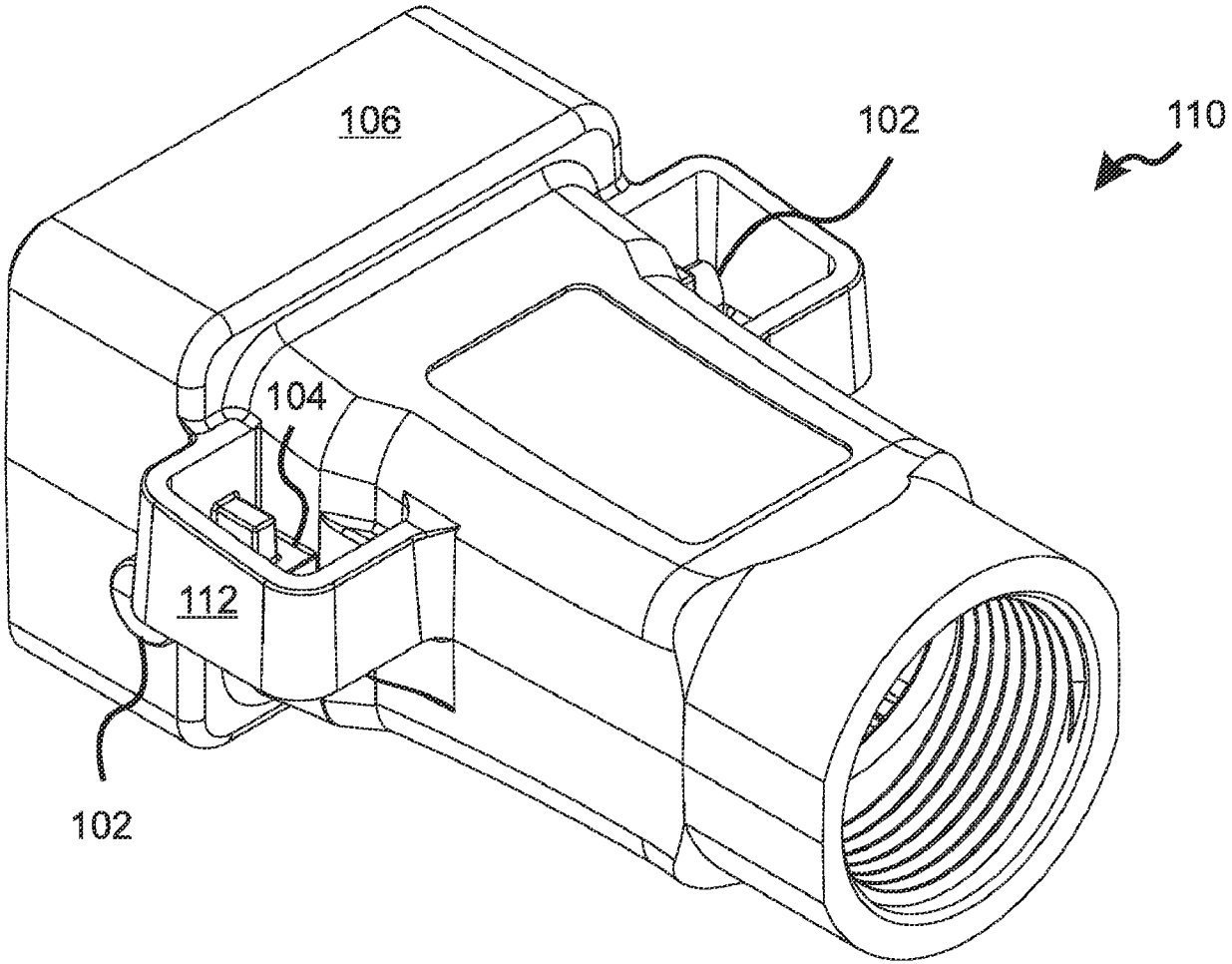
FIG. 1J is a reverse perspective view of the plug housing of FIG. 1I.
Figure 1K:
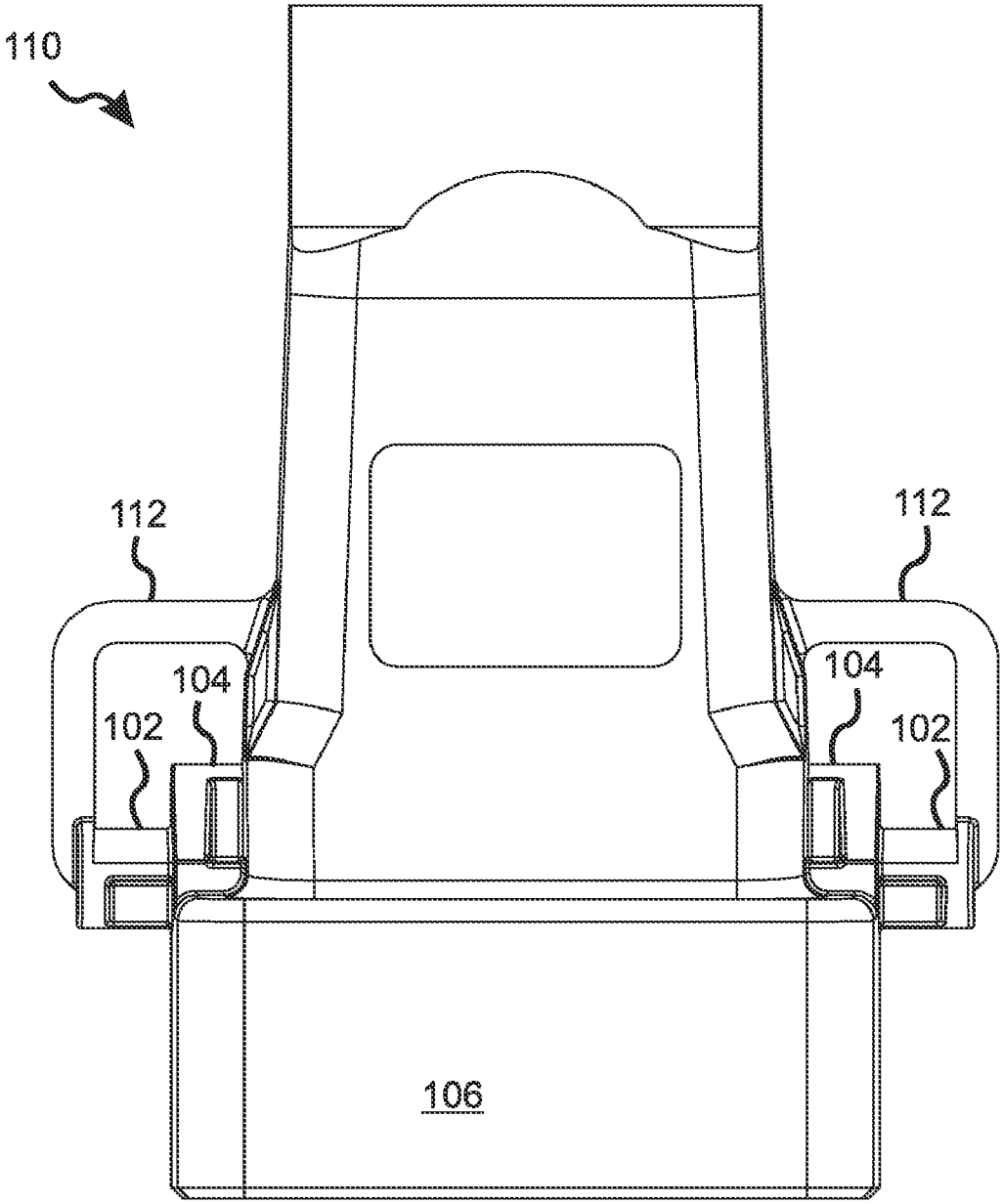
Figure 1L:
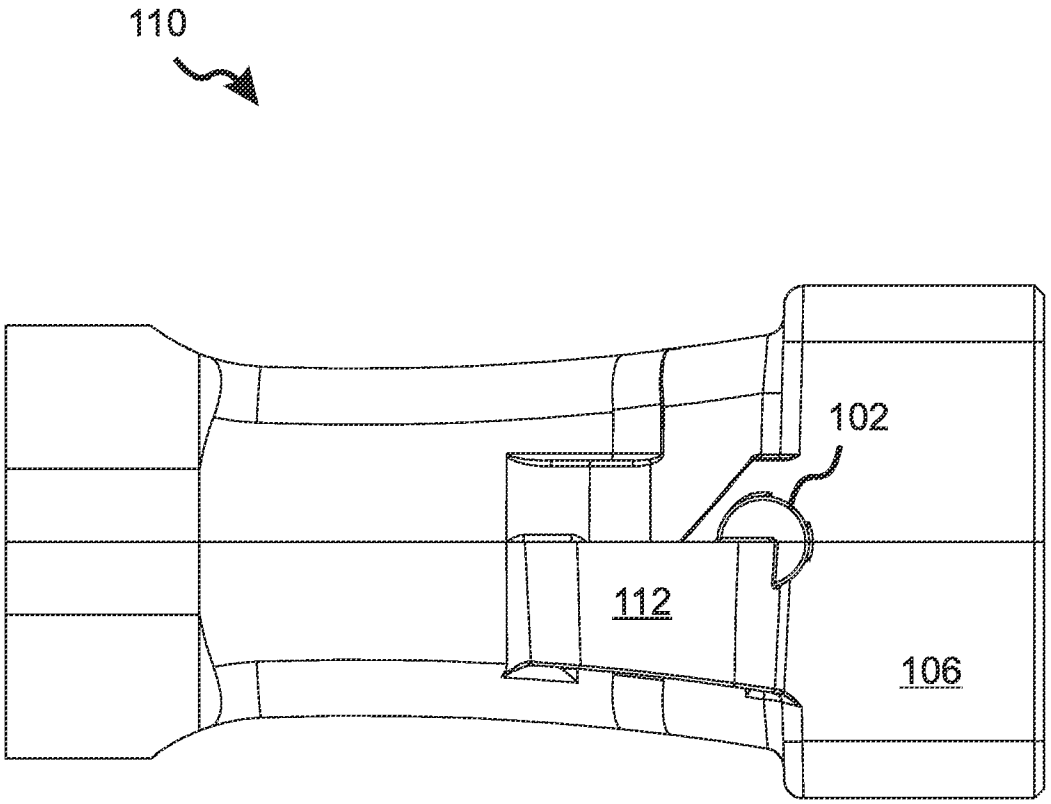
Figure 1M:
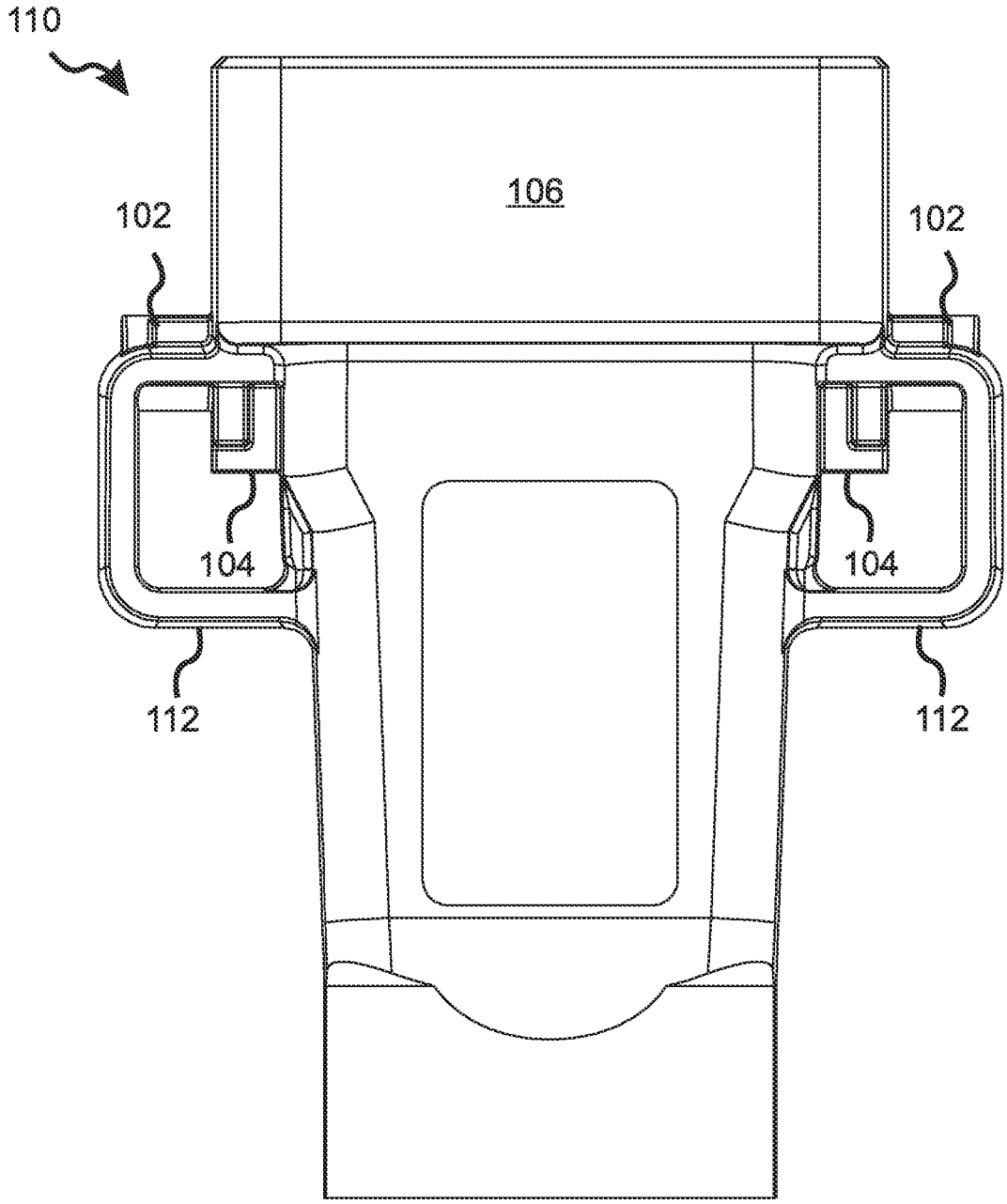
Figure 1N:
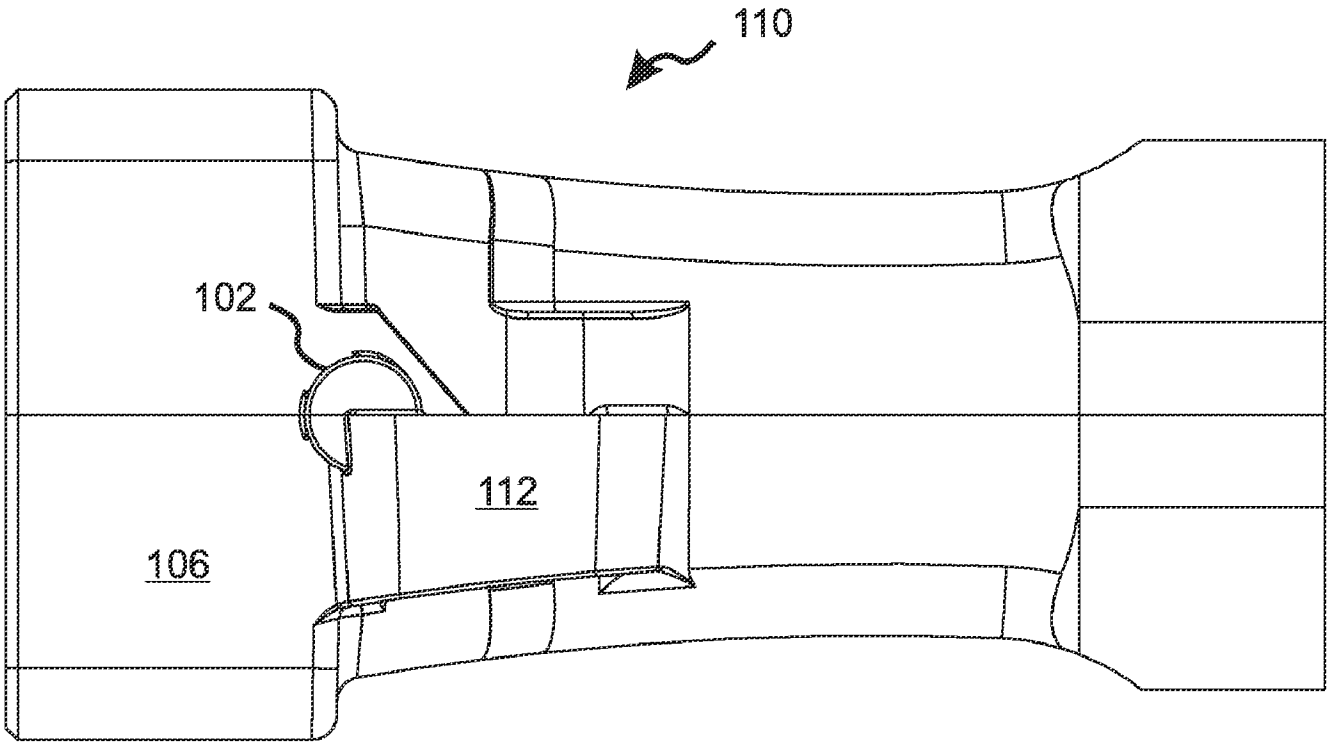
Figure 10:
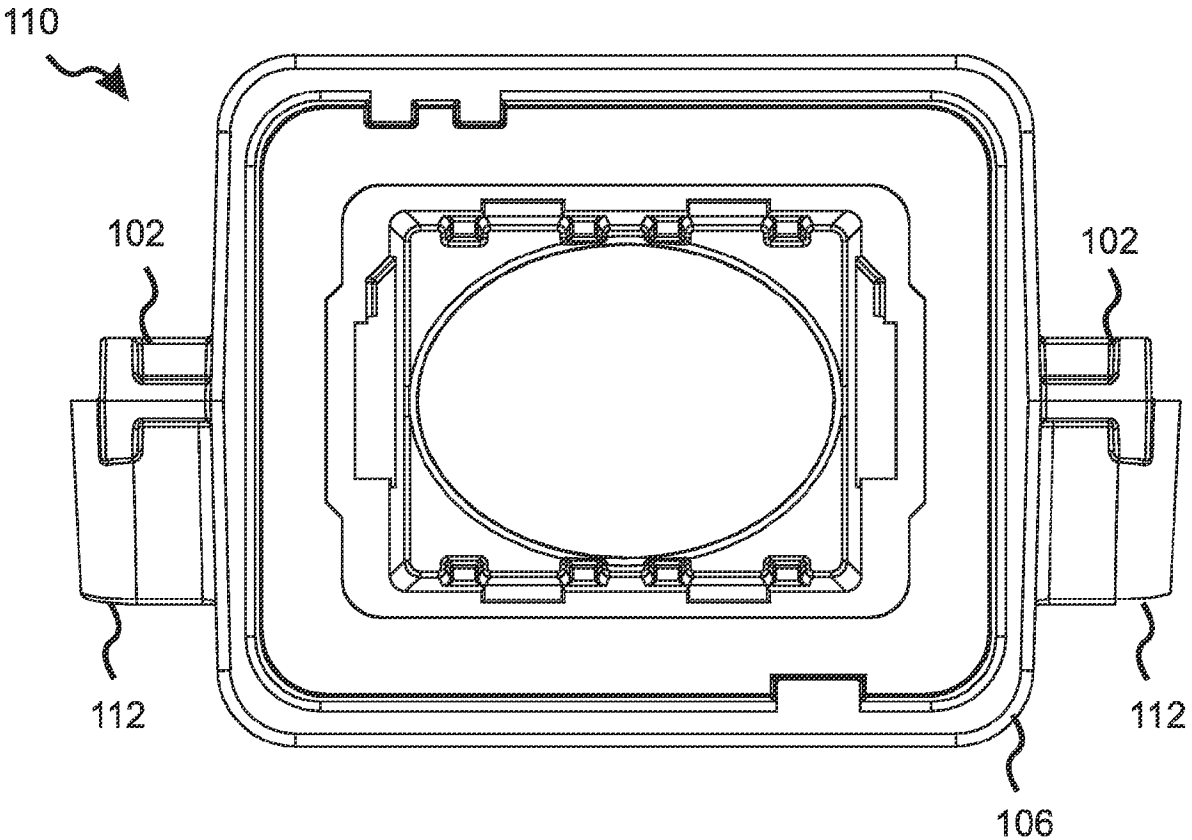
Figure 1P:
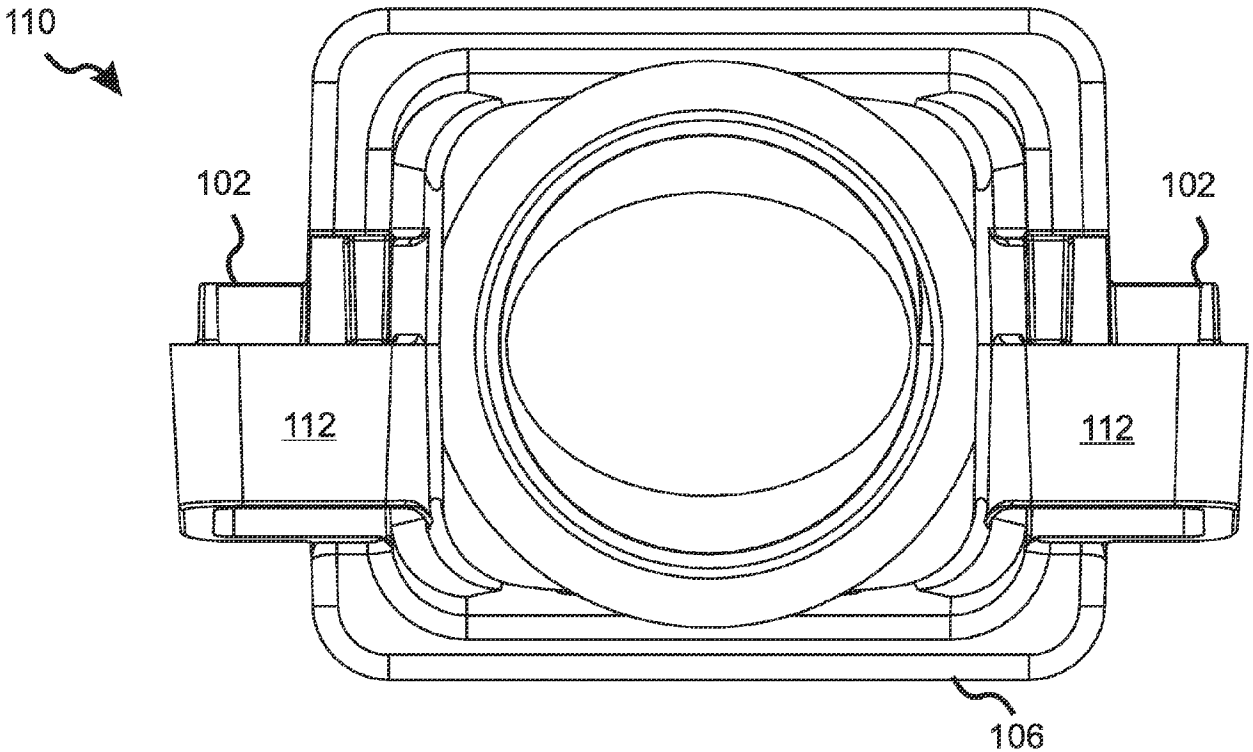

With reference to FIG. 1I, in embodiments of the present invention the plug housing 110 includes protective latching barriers 112 which extend around the latching regions where the catches 312 of the latching mechanism 300 engage with the catch tabs 104. The protective latching barriers 112 thereby further inhibit unintentional and intended release of the catches 312 from the catch tabs 104 without use of a suitable tool to circumvent the protective barriers 112.

FIGS. 1J through 1P are top, left, front, right, bottom, and rear views respectively of the embodiment of FIG. 1I.

Figure 2B:
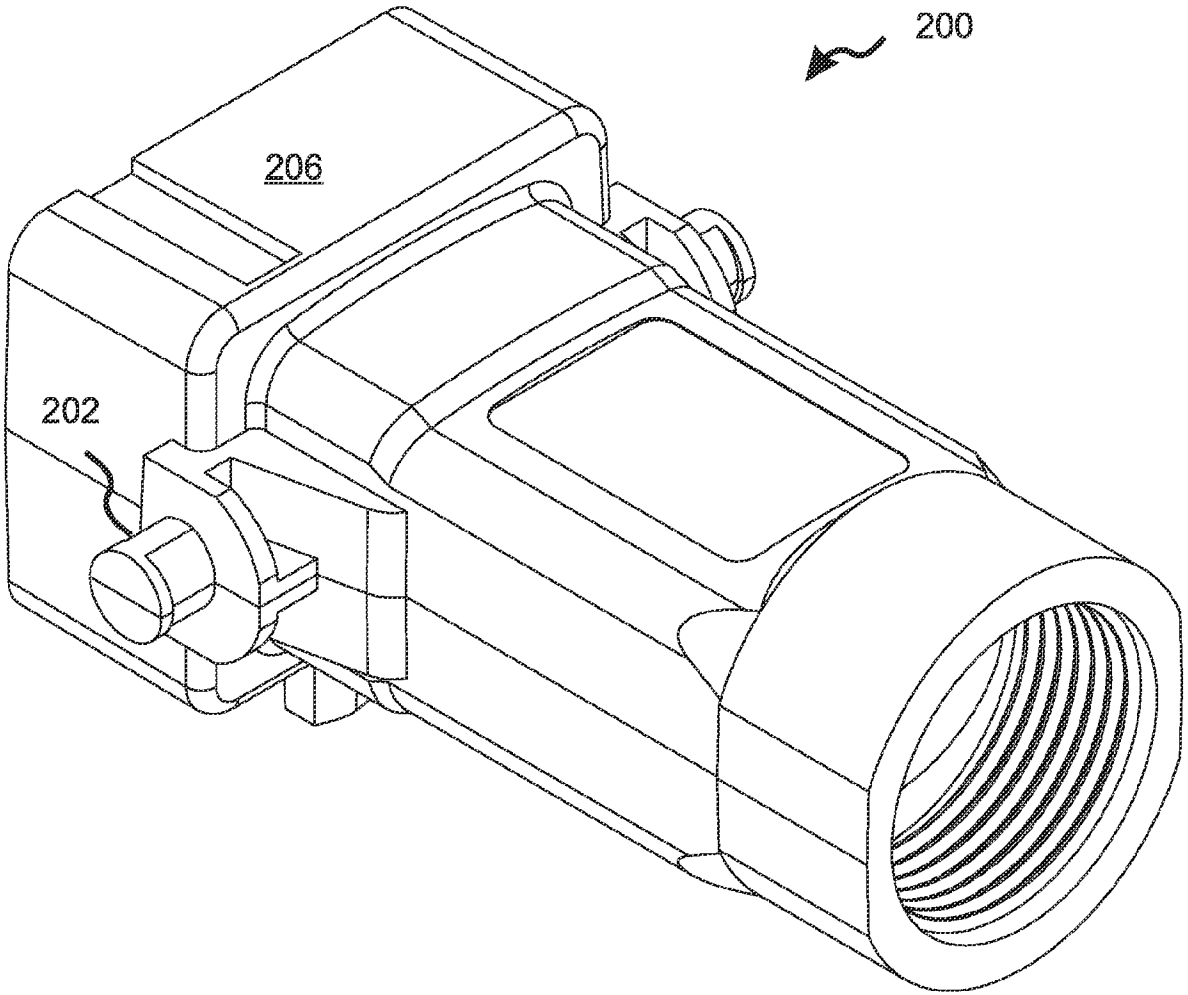
FIG. 2B is a reverse perspective view of the receptacle housing of FIG. 2A.
Figure 2C:
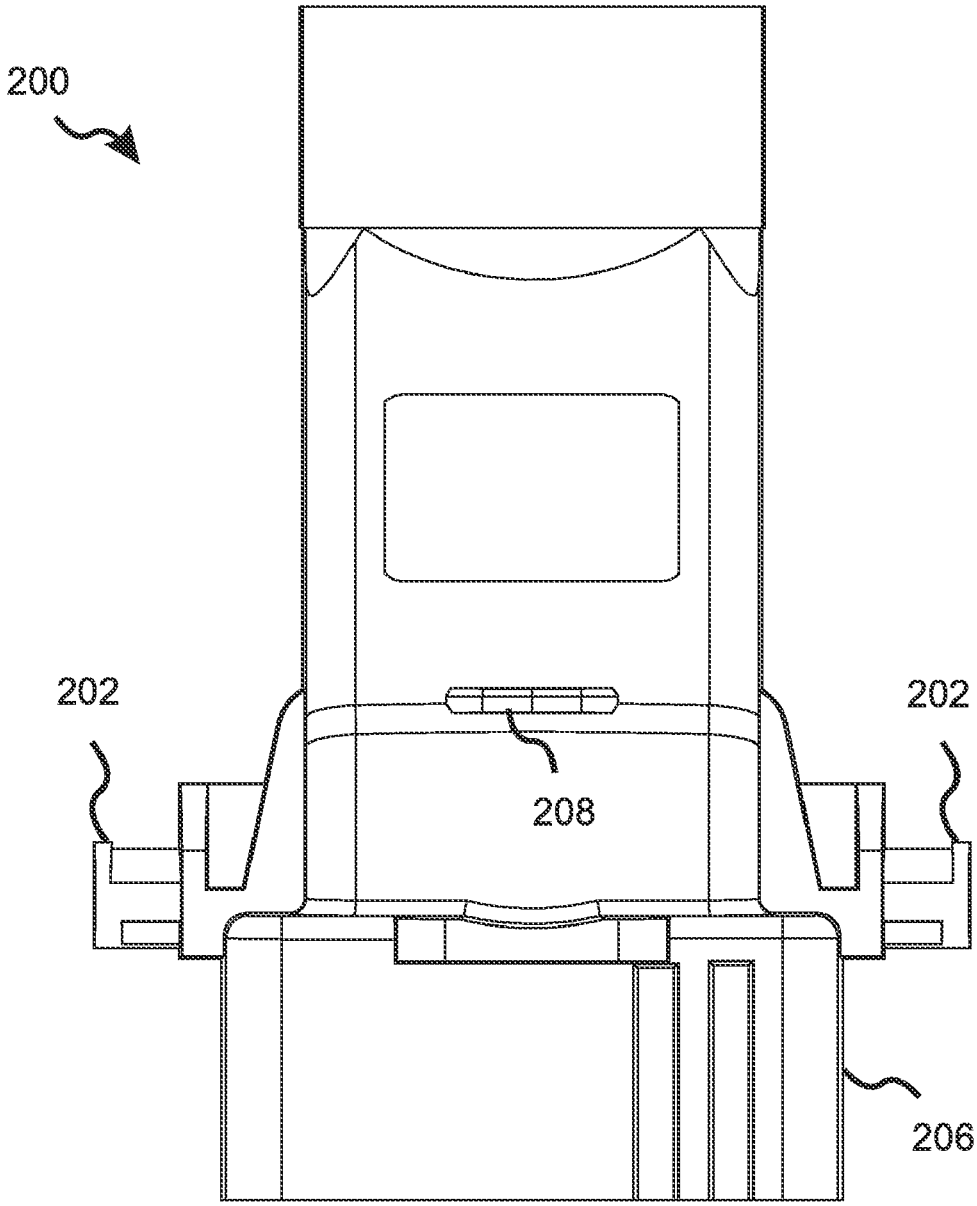
FIGS. 2C through 2H are top, right, bottom, left, front, and rear views respectively of the receptacle housing of FIG. 2A.
Figure 2D:
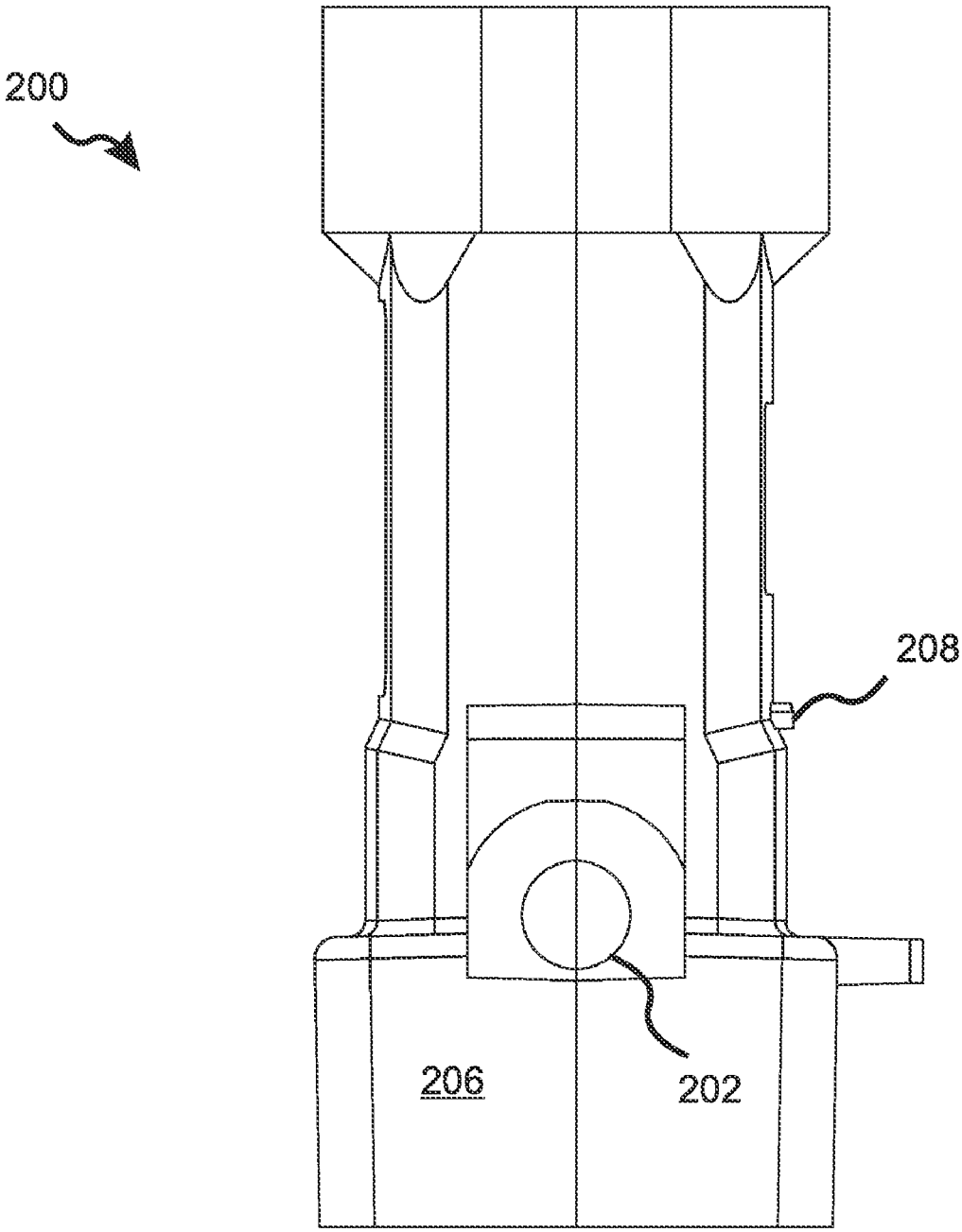
Figure 2E:
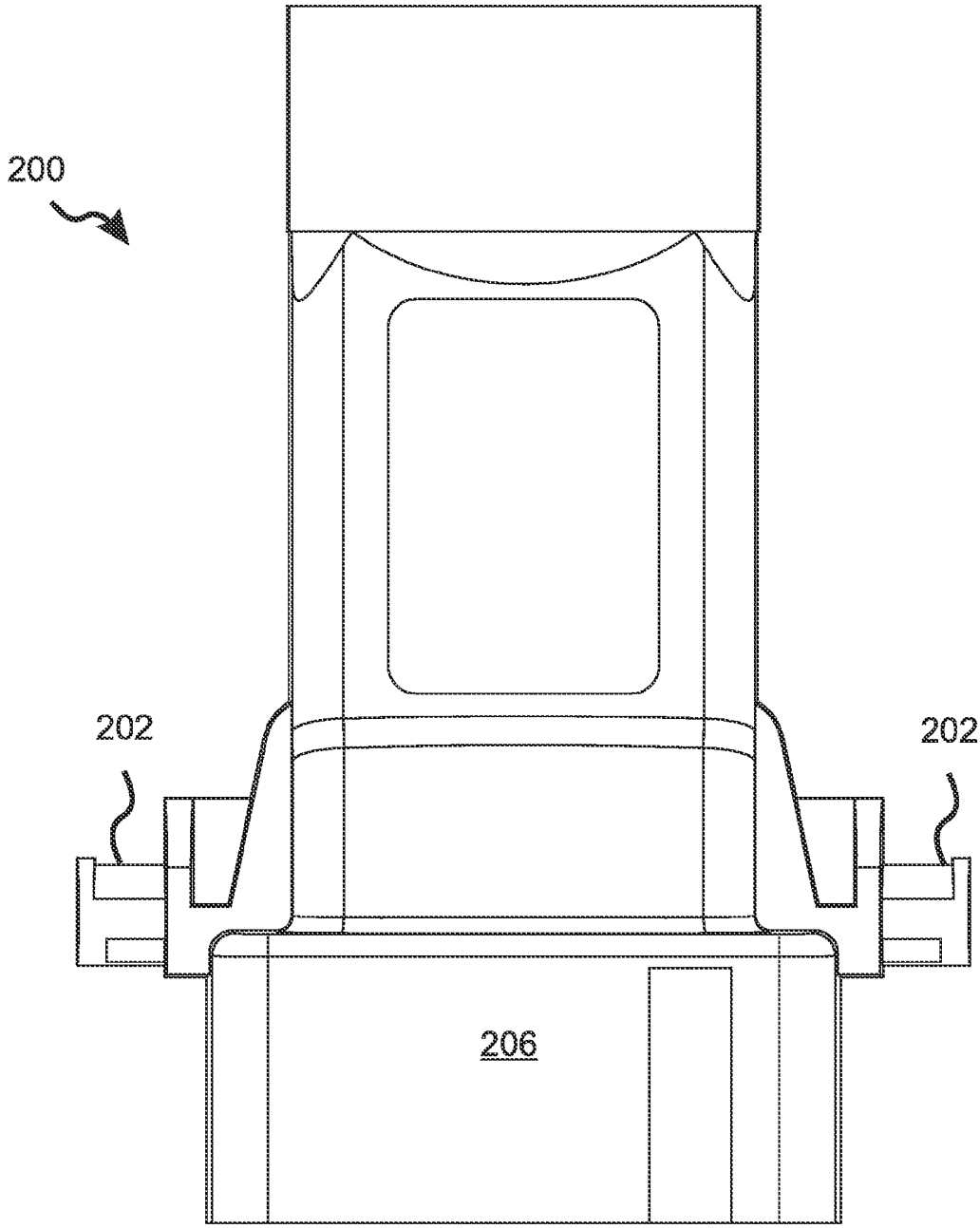
Figure 2F:
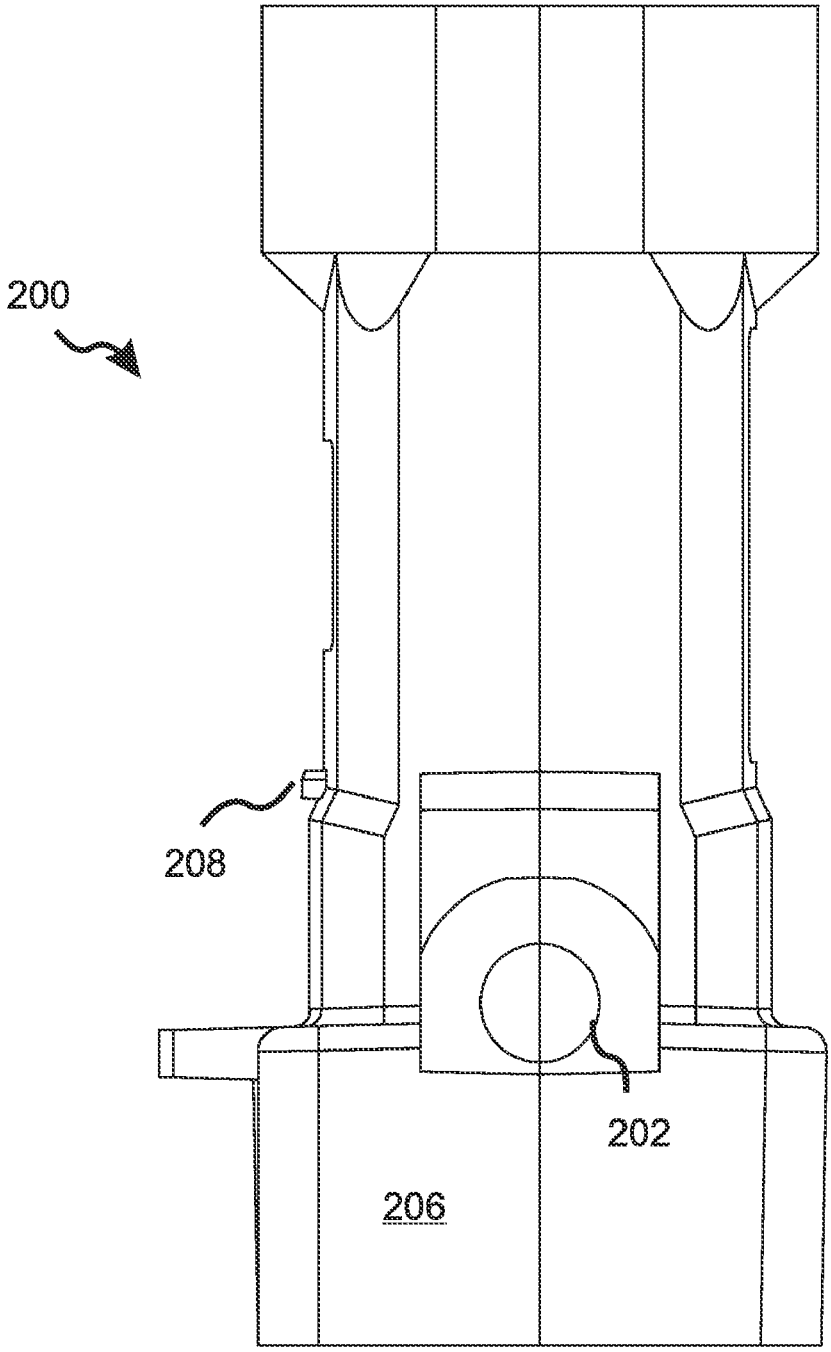
Figure 2G:
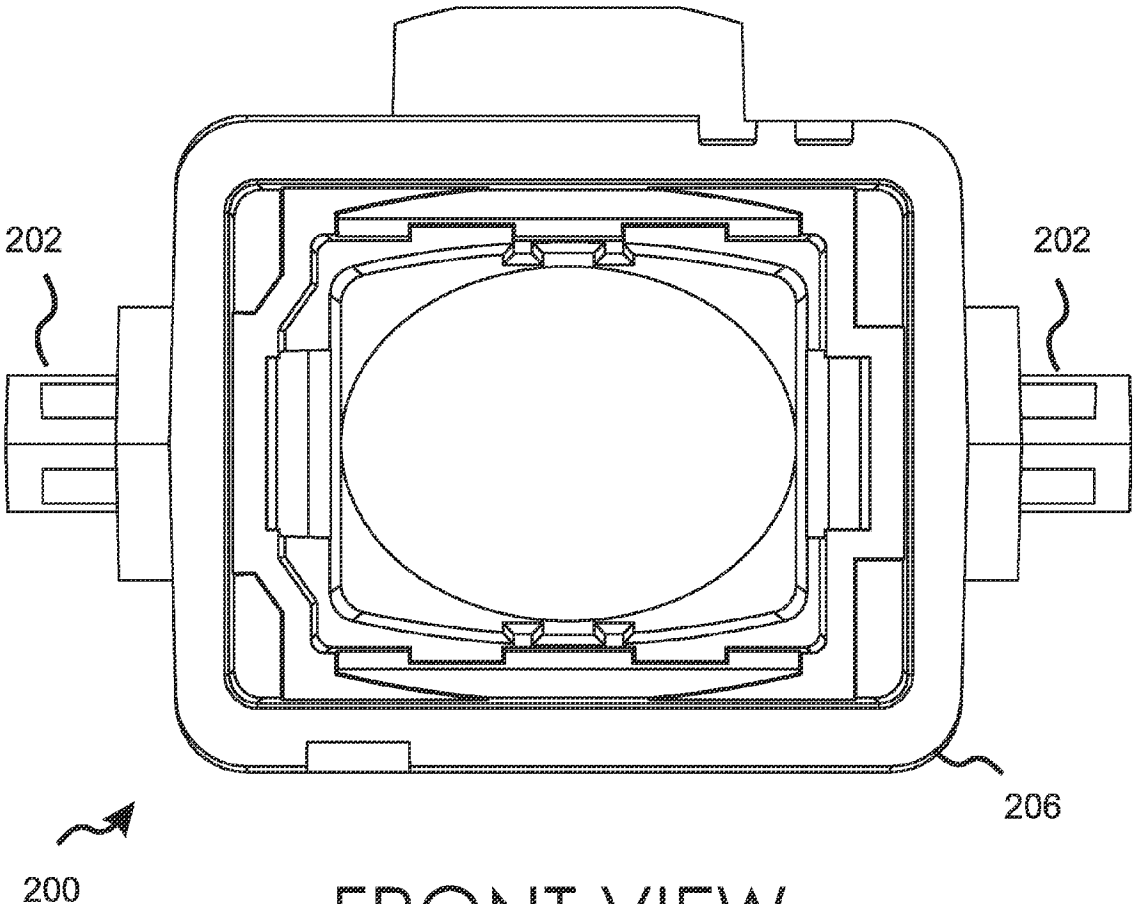
Figure 2H:
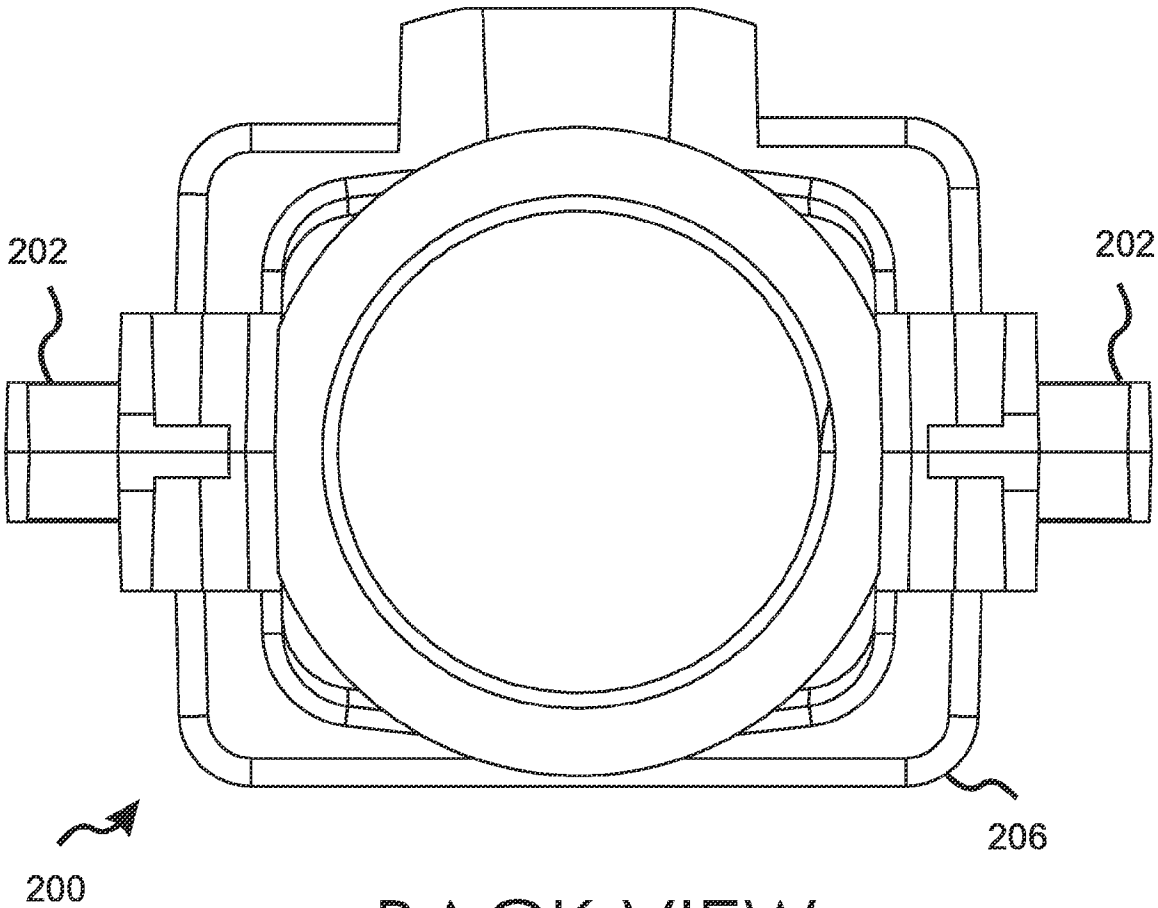

The receptacle housing 200 of the embodiment of FIG. 1A is shown in a front perspective view in FIG. 2A. The receptacle housing 200 includes a pair of latch pivots 202 extending outward from opposite sides of the overlapping shell 206 of the receptacle housing 200. The overlapping shell 206 of the receptacle housing 200 is sized so as to permit it to be slid into the overlapping shell 106 of the plug housing 100, 110, thereby providing electrical isolation of contacts contained therein, and providing a seal that inhibits contamination of the contacts by water and debris. The receptacle housing 200 also includes a retaining stop 208, the function of which is further explained below with reference to FIG. 4B. FIG. 2B is a reverse perspective view of the receptacle housing of FIG. 2A, and FIGS. 2C through 2H are top, right, bottom, left, front, and rear views respectfully of the receptacle housing of FIG. 2A.

Figure 3A:
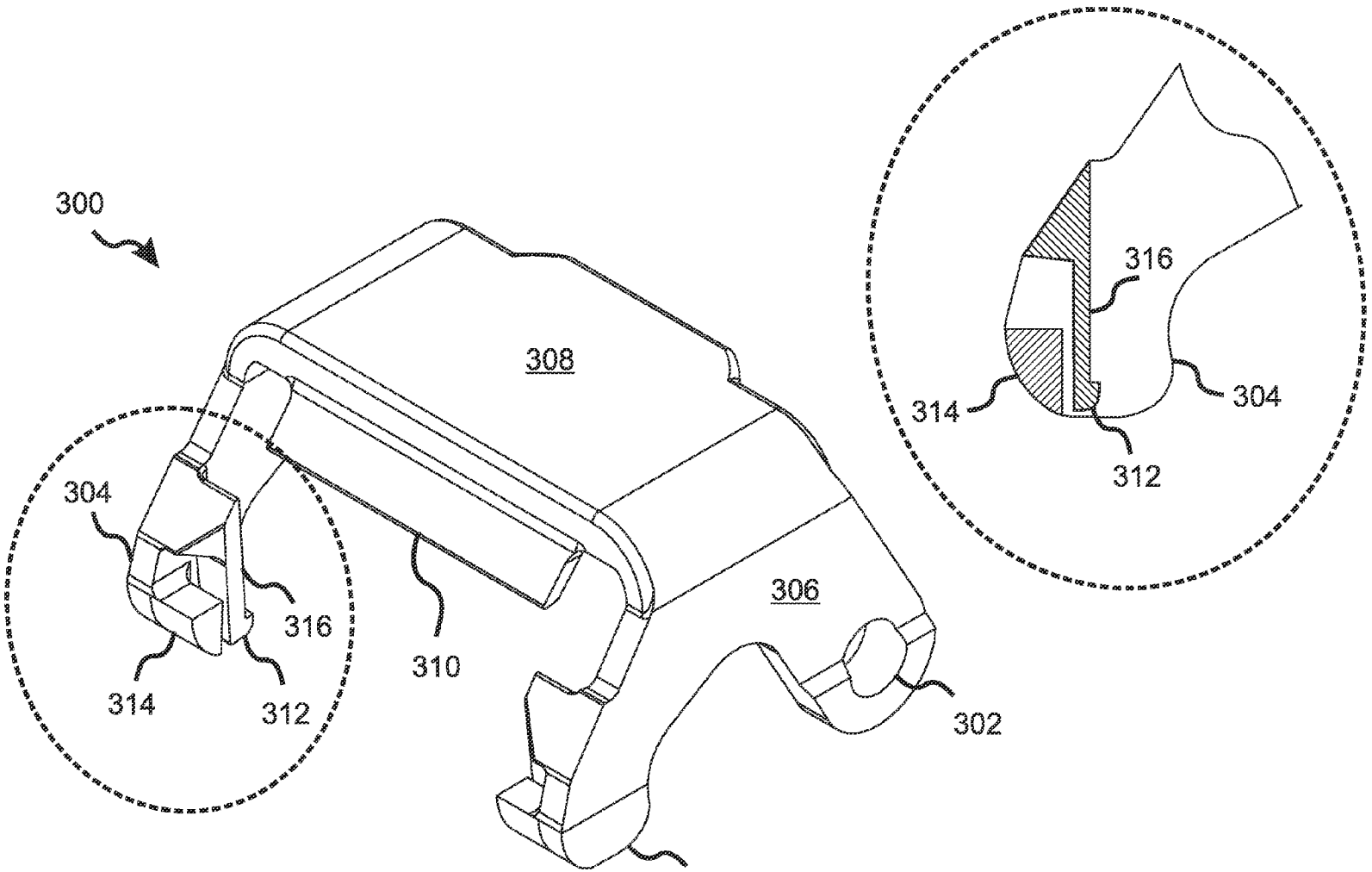
FIG. 3A is a perspective view of a latch mechanism of a preferred embodiment, including an insert which shows a detailed inner side view of one of the hooks and latches of the embodiment.

With reference to FIG. 3A, the present invention also includes a latch mechanism 300. The latch mechanism 300 includes pivot holes 302 which are rotatably mountable on the latch pivots 202 of the receptacle housing 200. The latch mechanism 300 also includes a pair of latching hooks 304 that can engage with the latch posts 102, of the plug housing 100 when the connector housings 100, 200 are mated.

The latch mechanism 300 includes sides 306 that interconnect the pivot holes 302 and the latch hooks 304, as well as a top 308 which is positioned above the juncture of the overlapping shells 106, 206 when the housings 100, 200 are mated and the latch hooks 302 are engaged with the latch posts 102. The top 308 of the latch mechanism further inhibits contamination of the electrical contacts by water and debris when the latch mechanism 300 is engaged. In the embodiment of FIG. 3A, a tab or protrusion 310 is provided on the cover 308 which facilitates grasping of or pushing against the cover so as to pivot the latch mechanism 300 about the pivot holes 302 and lift and disengage the latch hooks 304 from the latch posts 102.

Attached to each of the latch hooks 304 is a catch 312 and a retaining stop 314. In the embodiment of FIG. 3A, the catches 312 are attached to the latch hooks 304 by living hinges 316. When the latch hooks 304 are engaged with the latch posts 102, the catches 312 automatically engage with the catch tabs 104 which are attached to or proximal to the latch posts 102. Once engaged, the catches 312 prevent release of the latching mechanism until a screwdriver or similar tool is used to flex the living hinge 316 and release the catches 312 from the catch tabs 104. The catch stops 314 in the embodiment of FIG. 3A prevent excessive flexing of the living hinges 316 so as to prevent material fatigue and possible breakage of the living hinges 316.

Figure 3B:
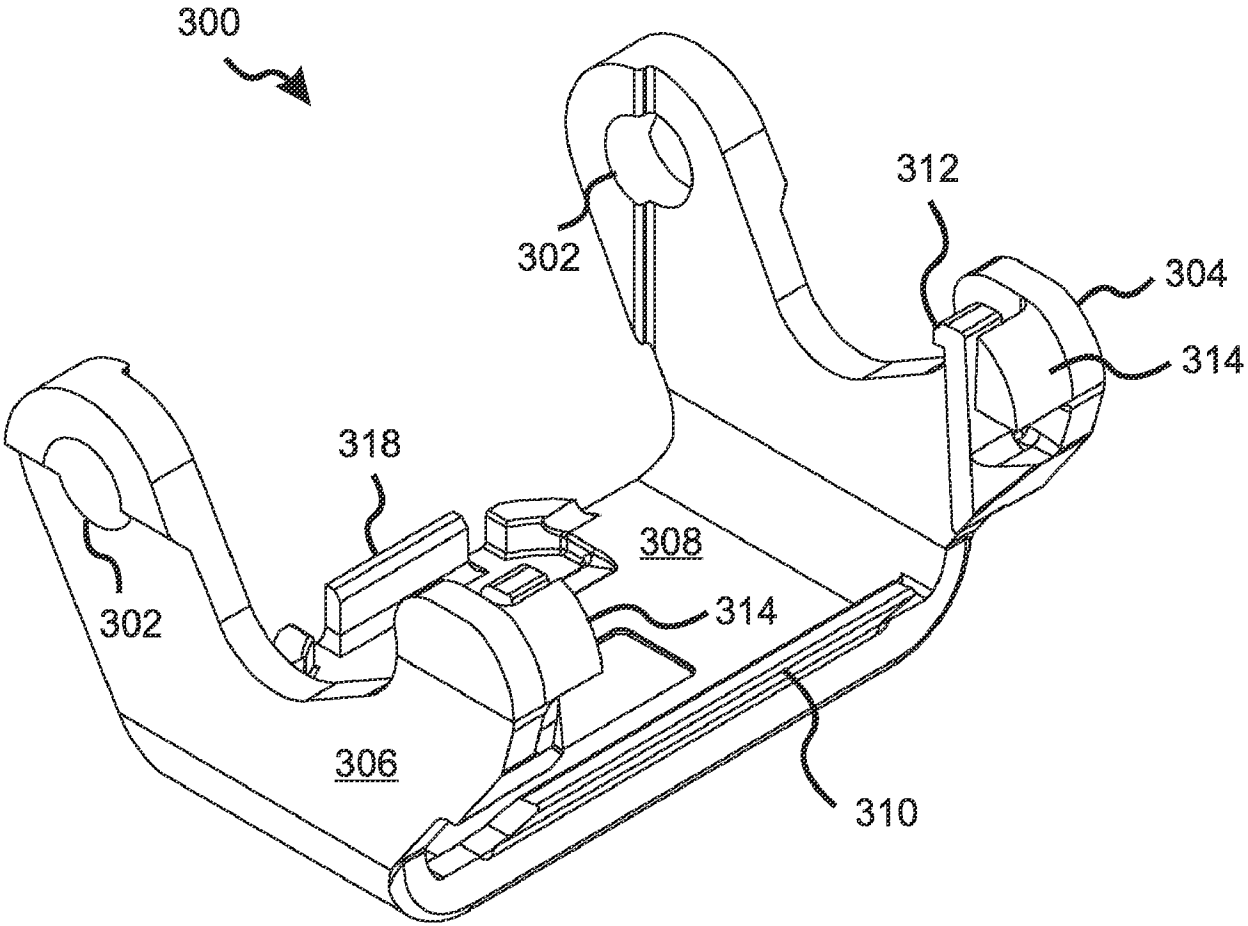
FIG. 3B is a reverse perspective view of the latch mechanism of FIG. 3A.
Figure 3C:
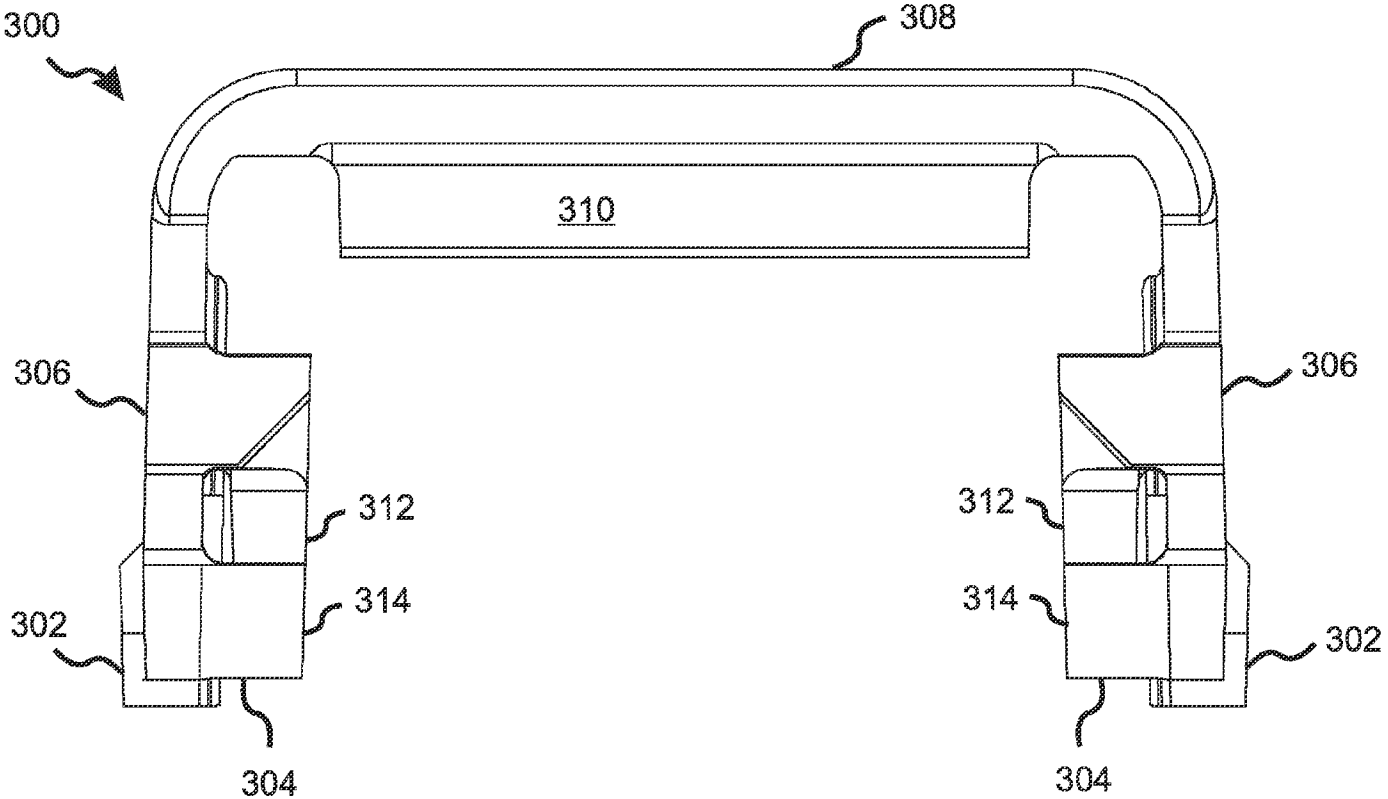
FIGS. 3C through 3H are front, right, left, rear, top, and bottom views respectively of the latch mechanism of FIG. 3A.
Figure 3D:
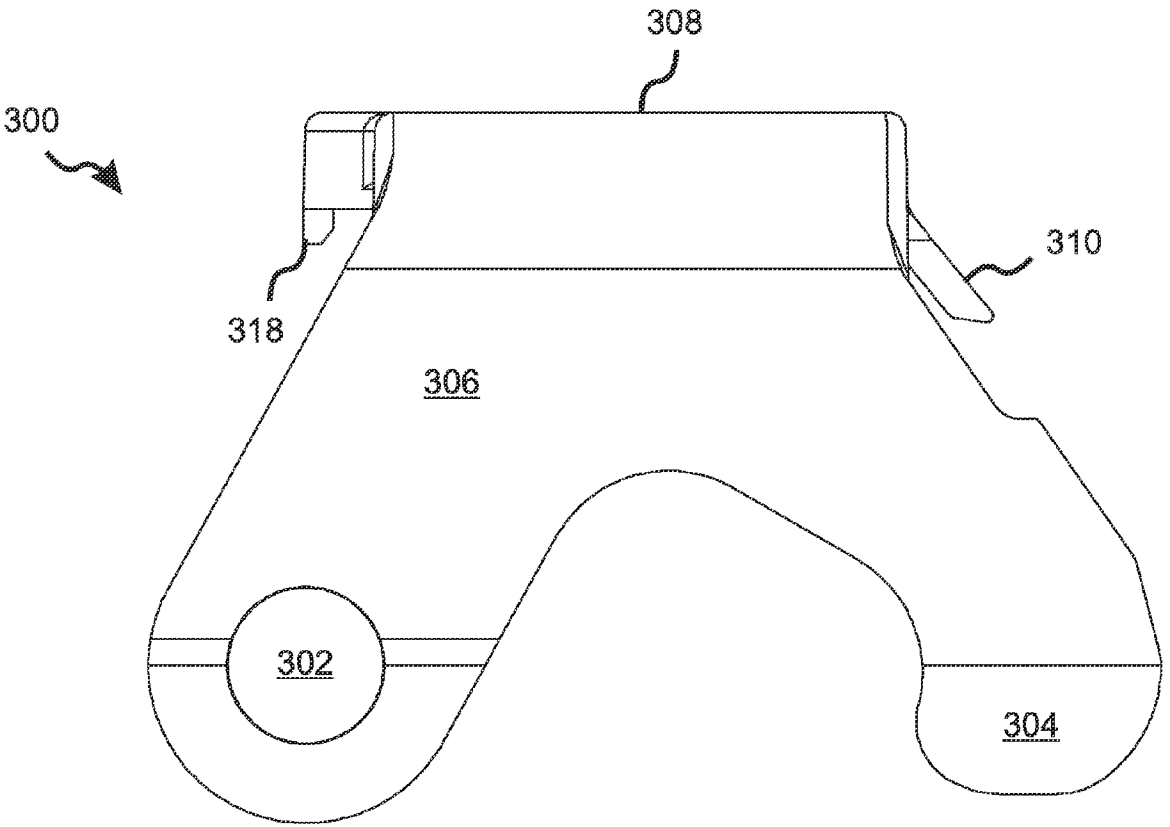
Figure 3E:
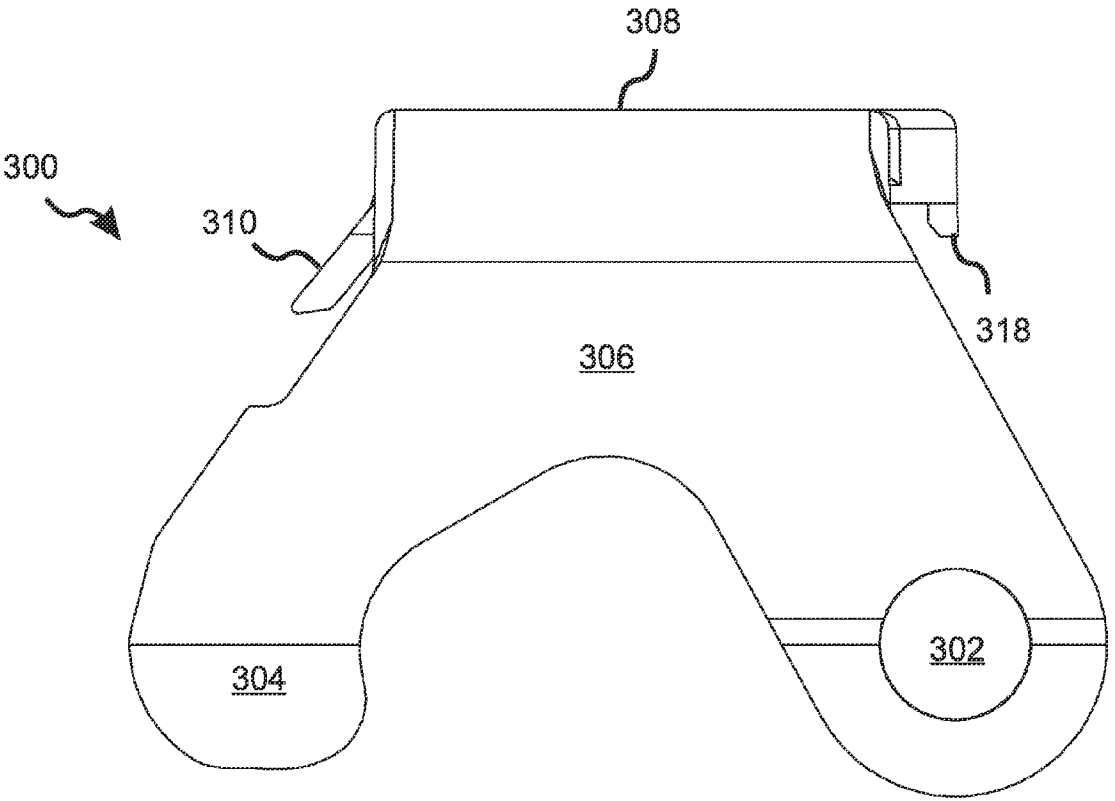
Figure 3F:
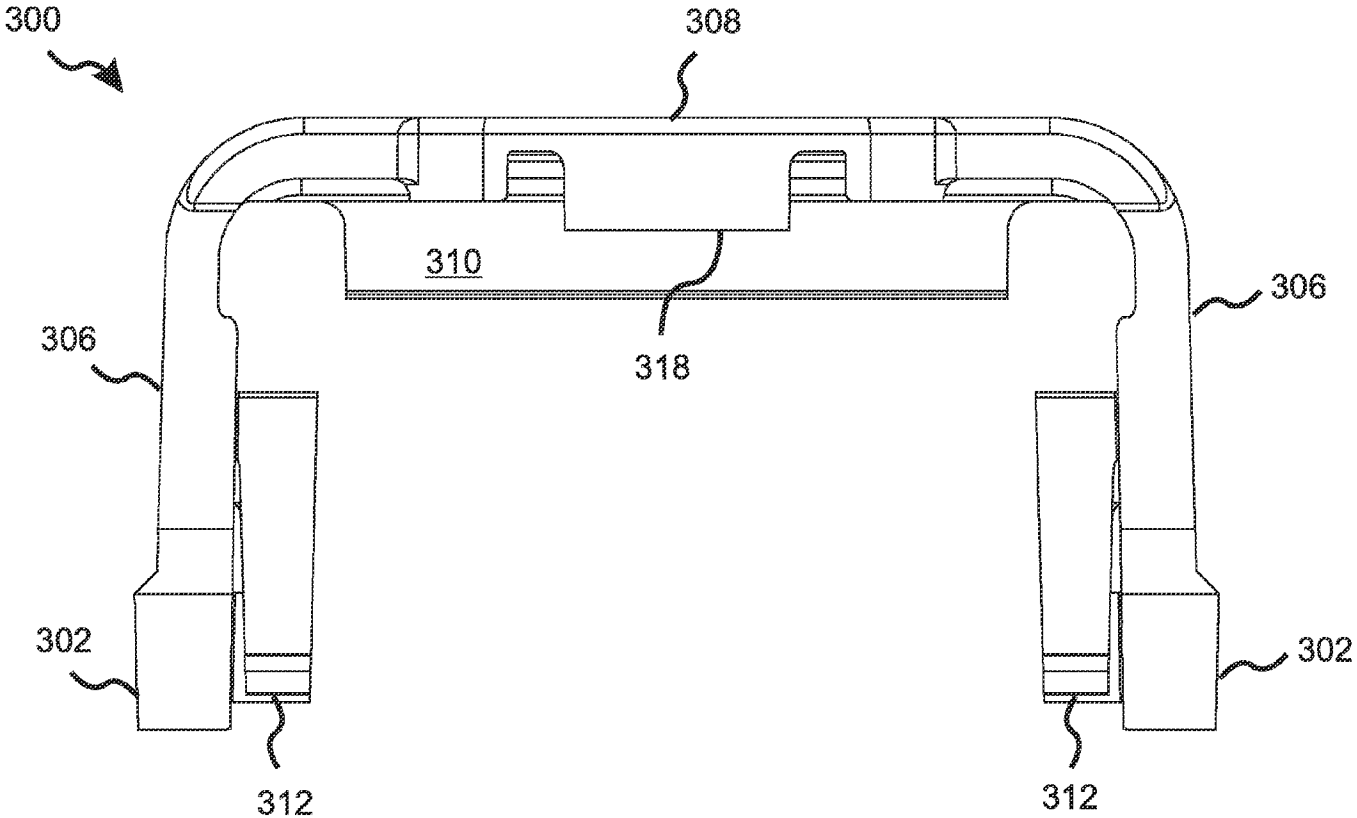
Figure 3G:
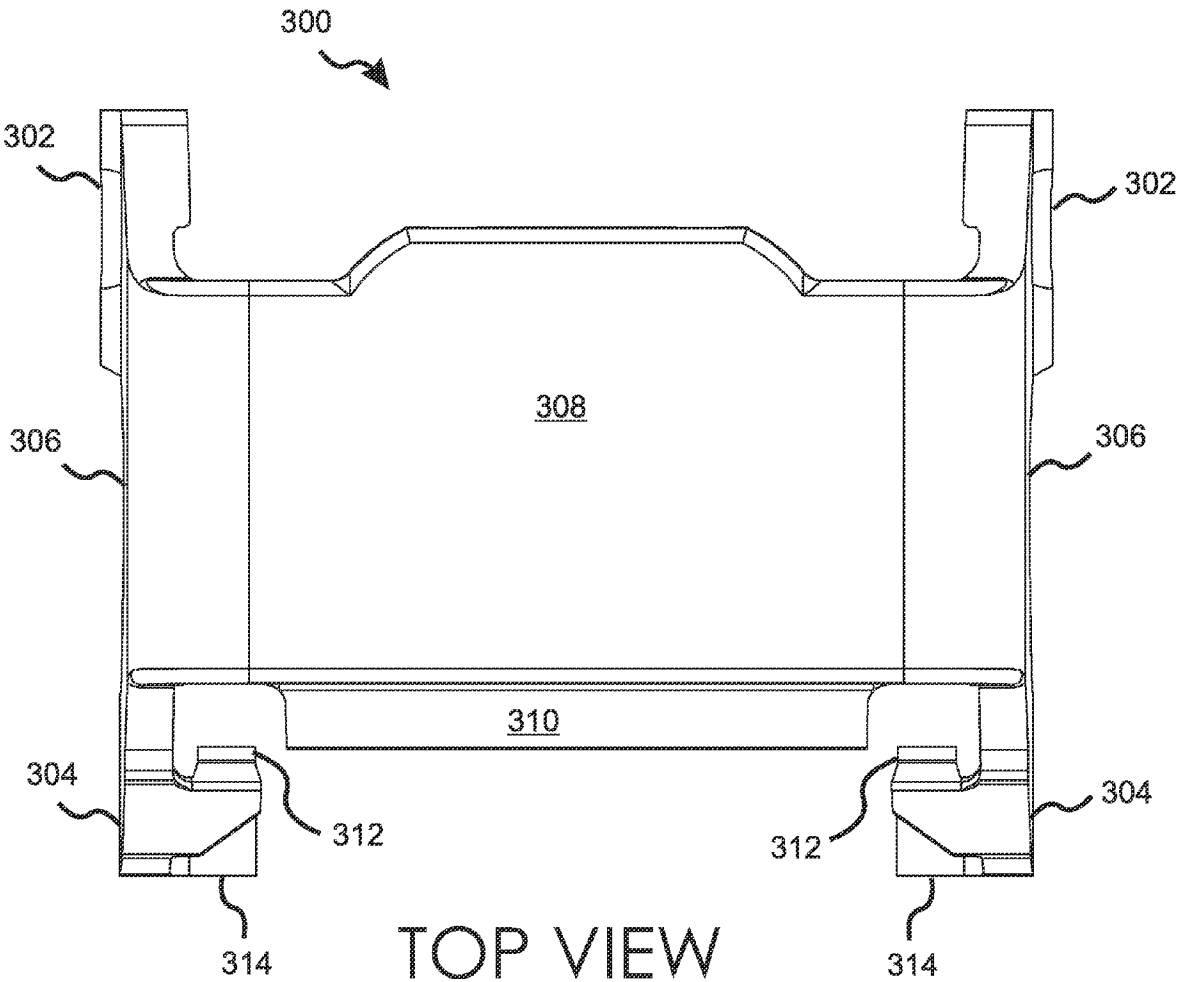
Figure 3H:
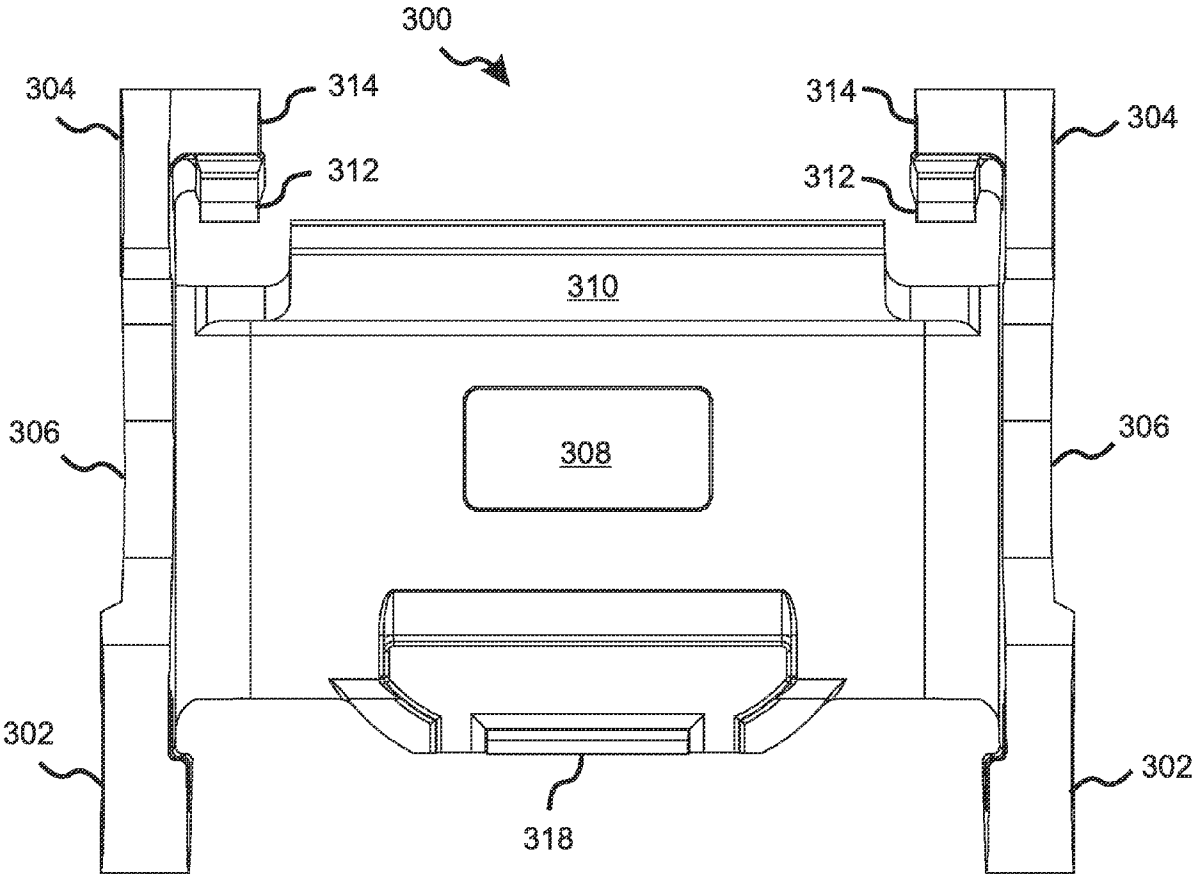

FIG. 3B is a reverse perspective view of the latch mechanism 300 of FIG. 3A. In addition to the features already described, the embodiment of FIG. 3B includes a retaining flap 318 visible in FIG. 3B which is attached to the lower rear region of the cover 308. The retaining flap 318 engages with the retaining stop 208 when the latch mechanism 300 is rotated about the pivot holes 302 to an open orientation and maintains the latch mechanism in the open orientation, as is described in more detail below with reference to FIG. 4B. FIGS. 3C through 3G are front, right, left, back, top, and bottom views, respectively, of the latch mechanism 300 of FIG. 3A.

Figure 4A:
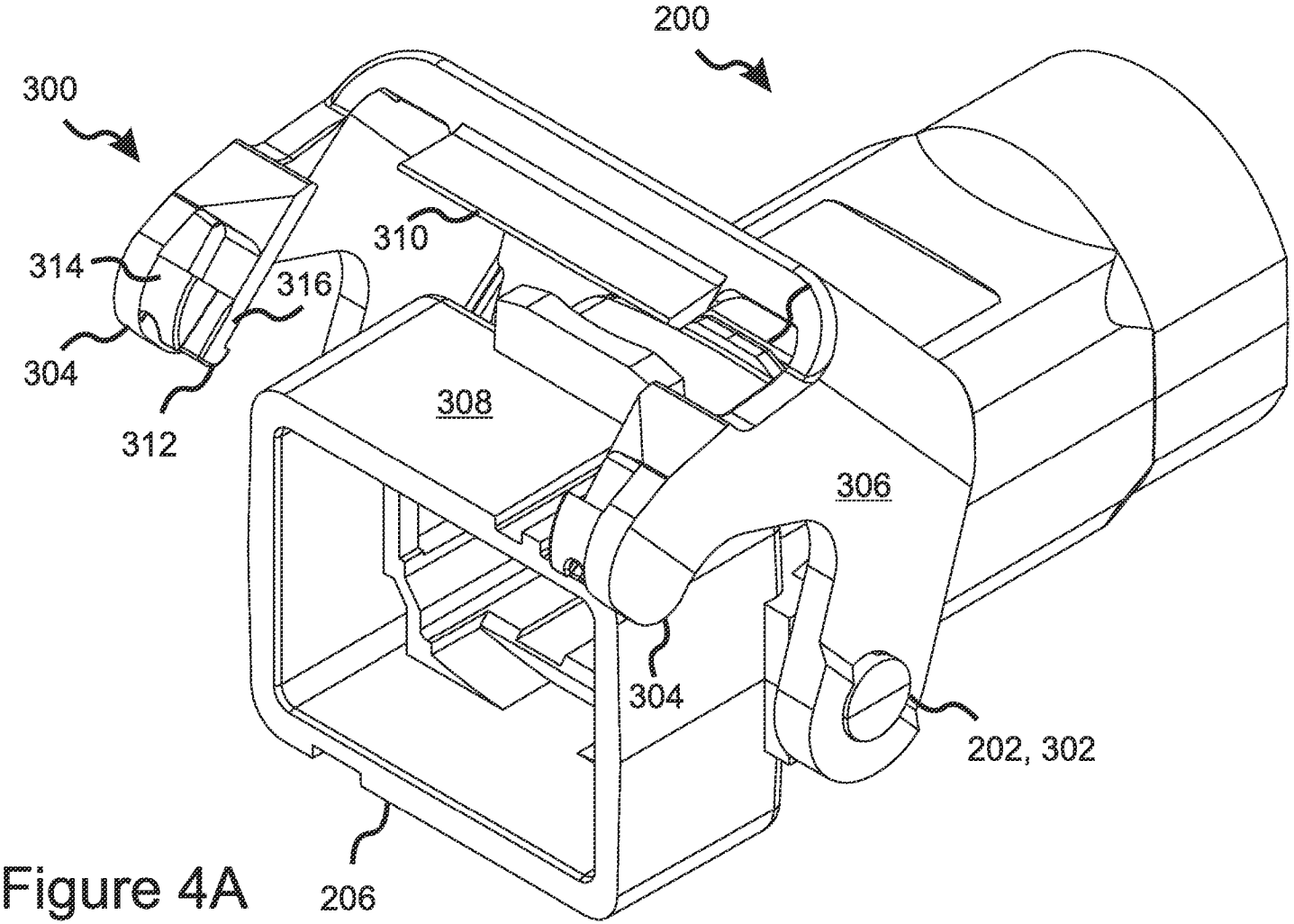
FIG. 4A is a perspective view showing the latch mechanism of FIG. 3A assembled with the receptacle housing of FIG. 2A, the latch mechanism being shown in its latched orientation.

FIG. 4A illustrates the latch mechanism 300 of FIG. 3A assembled with the receptacle housing 200 of FIG. 2A. In FIG. 4A, the latch mechanism 300 is shown in its unlatched or open orientation, ready for connection to the receptacle housing.

Figure 4B:
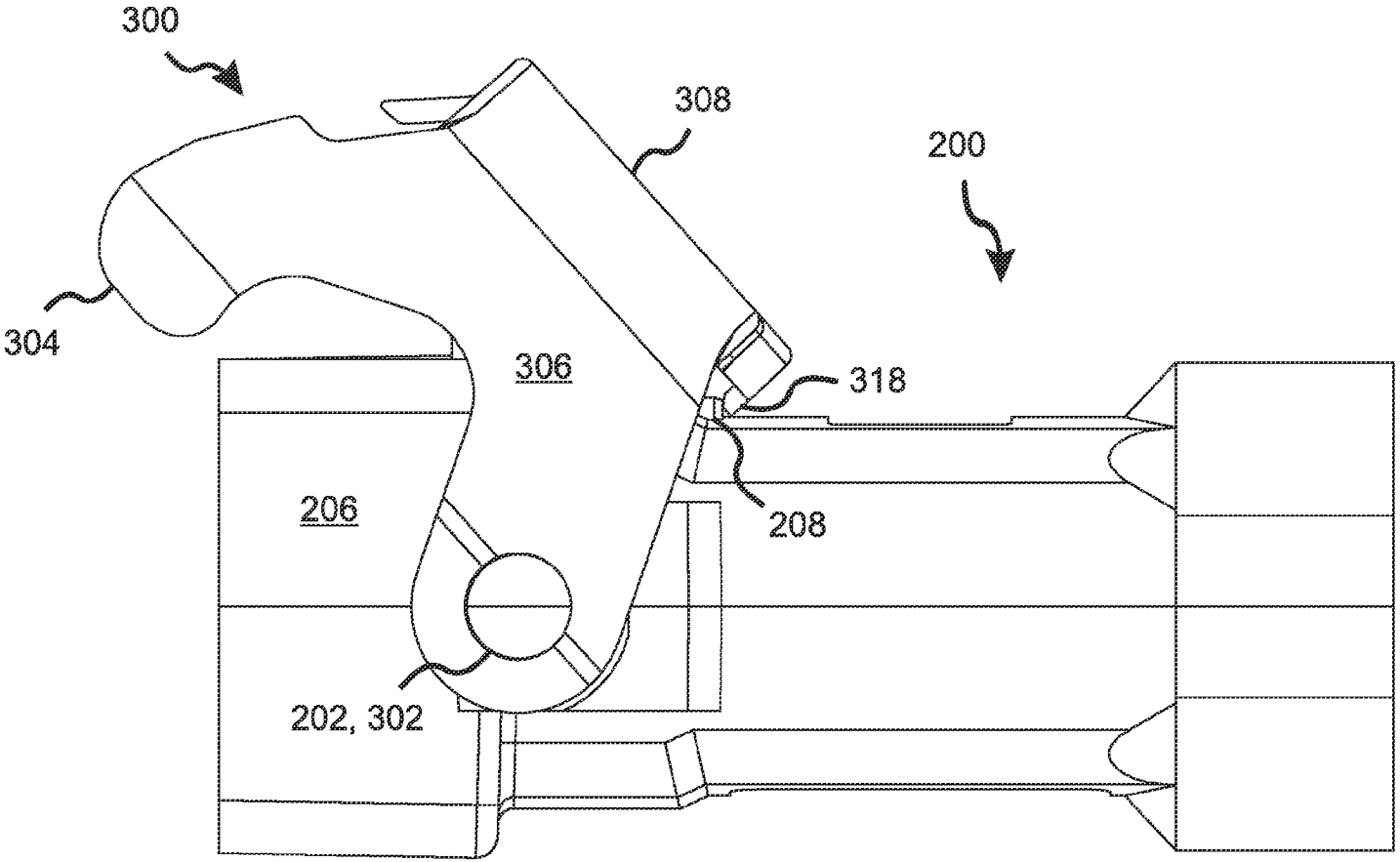
FIG. 4B is a side view of the assembled latch mechanism and receptacle housing of FIG. 4A, shown with the latch mechanism in its open orientation.

FIG. 4B is a side view of the receptacle housing 200 and latch mechanism 300 of FIG. 4A. It can be seen in FIG. 4B that when the latch mechanism 300 is rotated to its open orientation, it is held there by engagement of the retaining flap 318 of the latch mechanism 300 with the retaining stop 208 of the receptacle housing 200. This feature facilitates release of the plug housing 100, 110 from the receptacle housing 200 using only one hand and/or while wearing gloves, since a separate hand is not required to hold the latch mechanism 300 open while pulling the plug housing 100, 110 and the receptacle housing 200 apart from each other. In the embodiment of FIG. 4B, the retaining flap 318 and retaining stop 208 function as a latch retaining mechanism. Other embodiments include different mechanisms known in the art that automatically capture and retain the latch mechanism 300 in it its open orientation until it is pushed shut again.

Figure 4C:
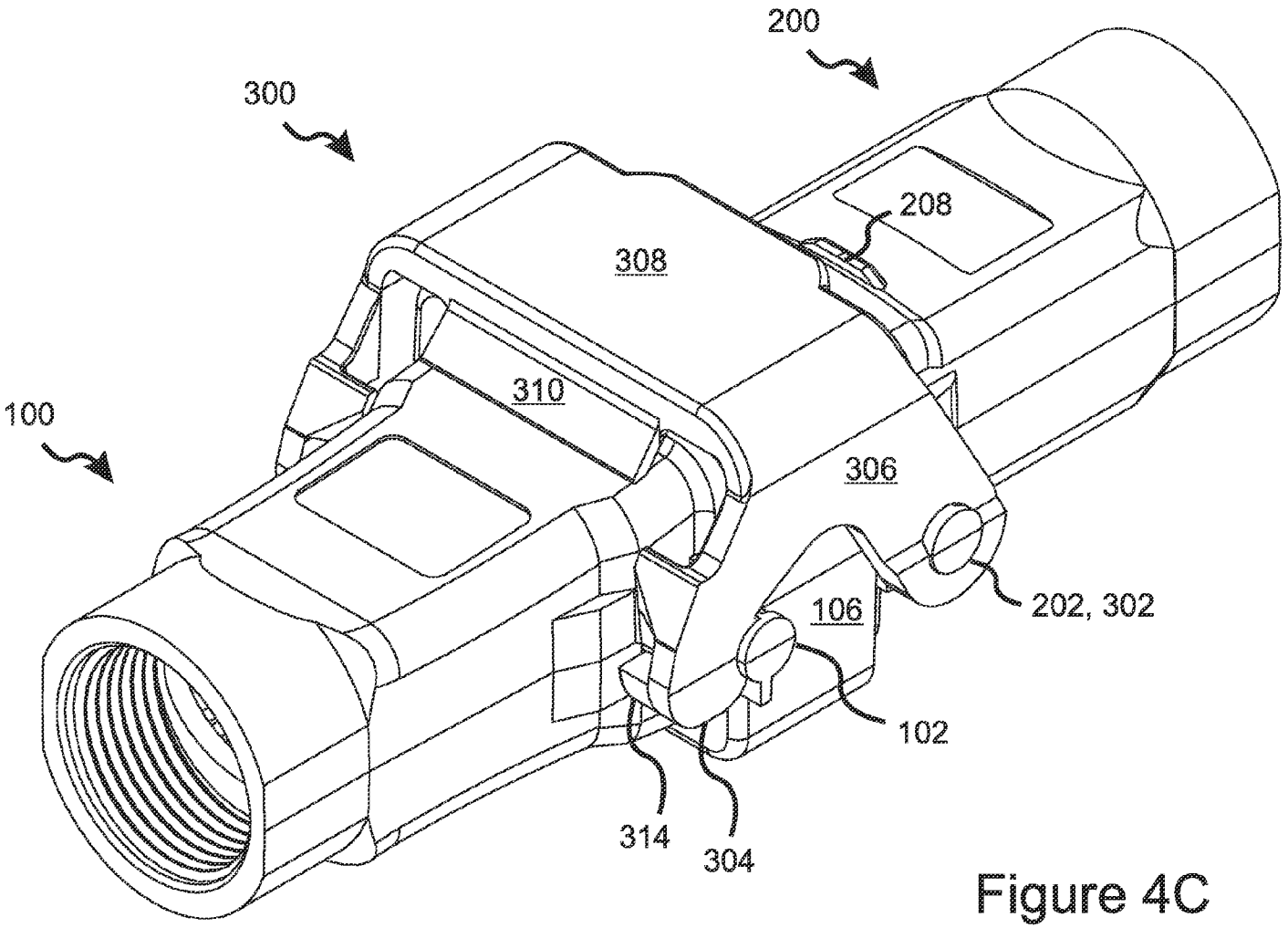
FIG. 4C is a perspective view of the plug housing of FIG. 1A mated with the receptacle housing of FIG. 2A and latched thereto by the latch mechanism of FIG. 3A.
Figure 4D:
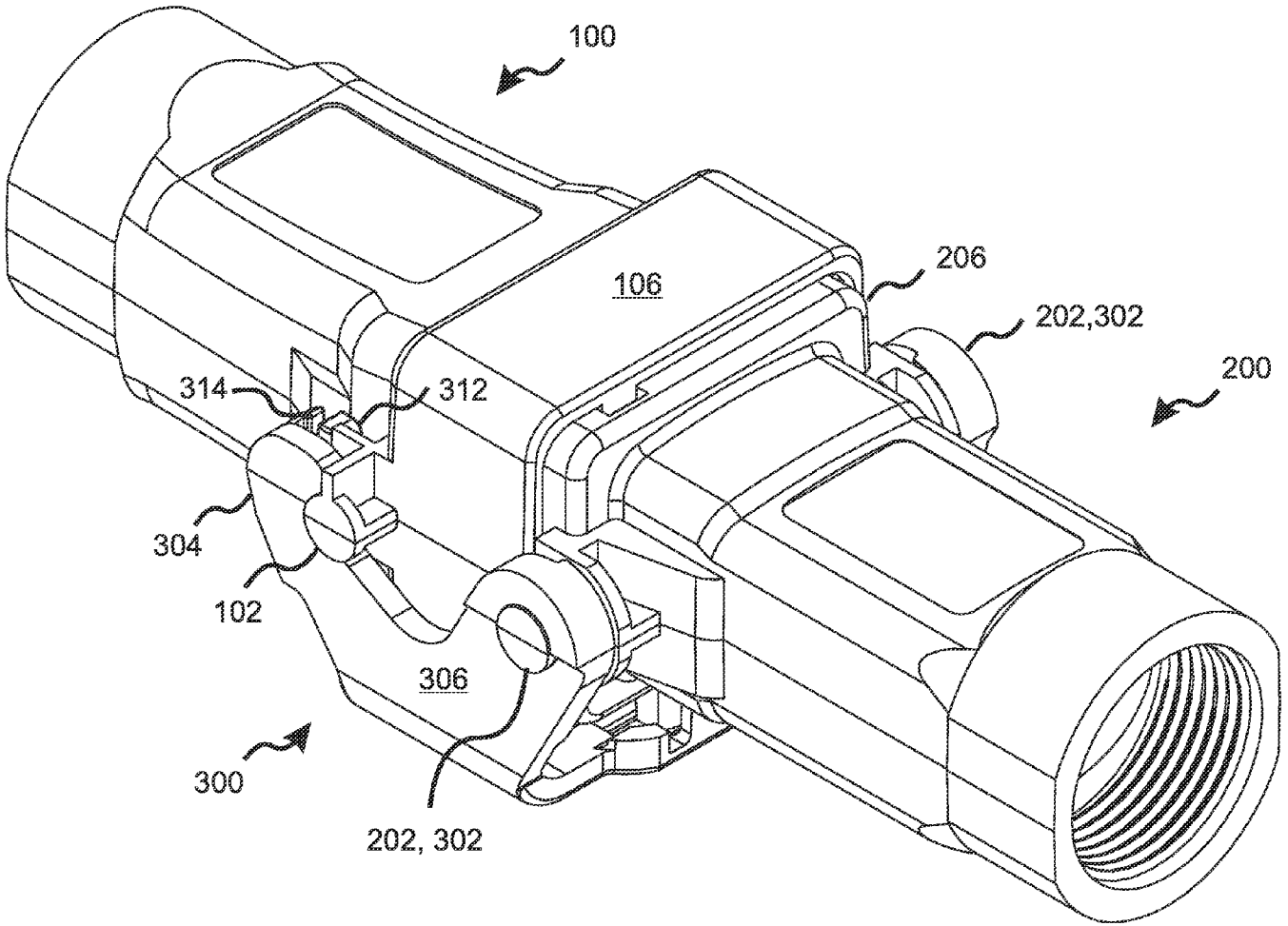
FIG. 4D is a reverse perspective view of the assembly of FIG. 4C.

FIG. 4C is a perspective illustration of the plug housing 100 of FIG. 1A, the receptacle housing 200 of FIG. 2A, and the latch mechanism 300 of FIG. 3A, all assembled and latched together as a unit. The overlapping shell 206 of the receptacle housing 200 has been inserted into the compatible shell 106 of the plug housing 100. The pivot holes 302 of the latch mechanism 300 have been rotatably engaged with the latch pivots 202 of the receptacle housing 200, and the latch hooks 304 have been engaged with the latch posts 102 of the plug housing 100. Although not visible in FIG. 4C, the catches 312 of the latching mechanism 300 have engaged with the catch tabs 104 of the plug housing 100. The assembled embodiment of FIG. 4C is shown in a reverse perspective view in FIG. 4D.

Figure 4E:
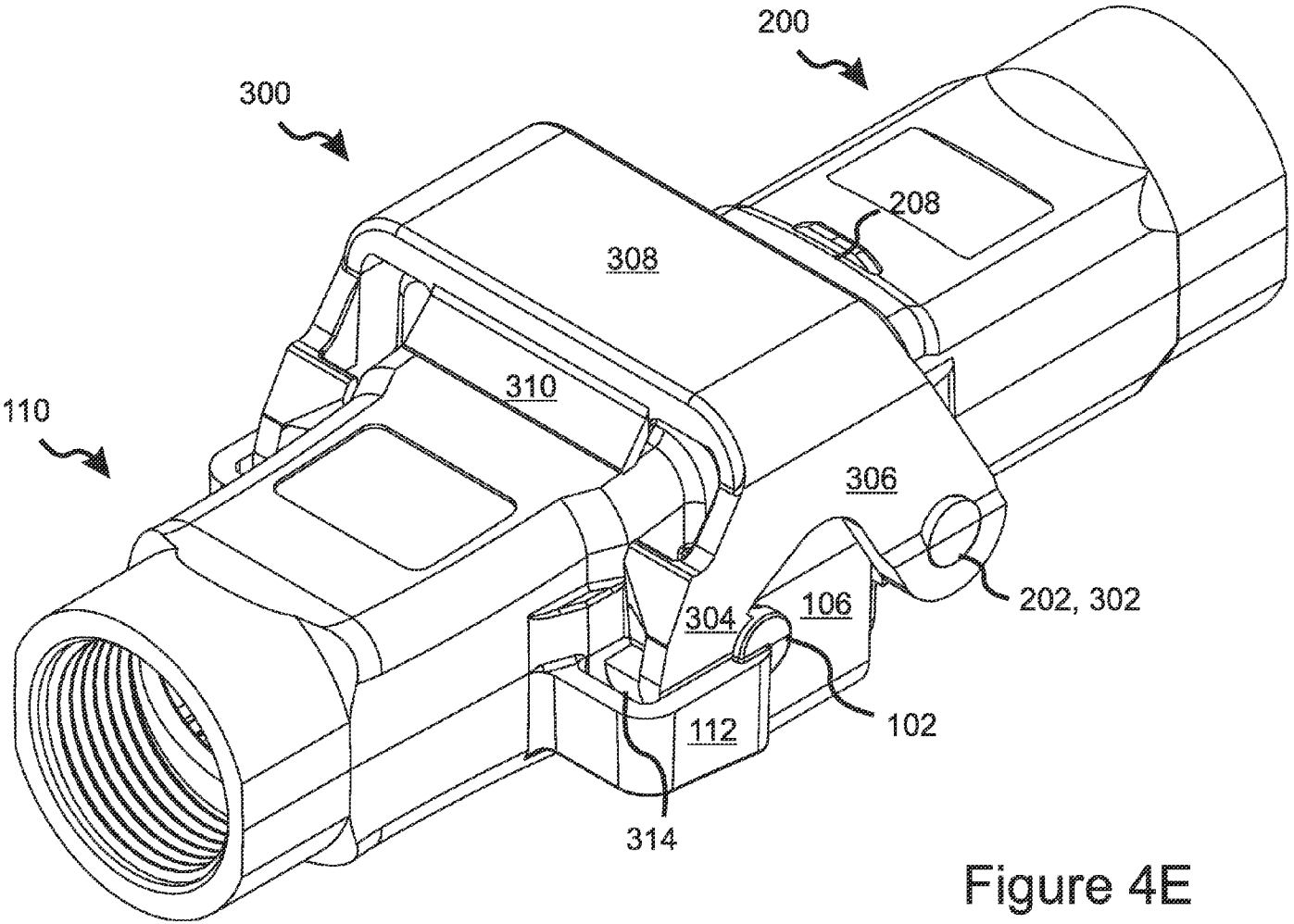
FIG. 4E is a perspective view of the plug housing of FIG. 1I mated with the receptacle housing of FIG. 2A and latched thereto by the latch mechanism of FIG. 3A.
Figure 4F:
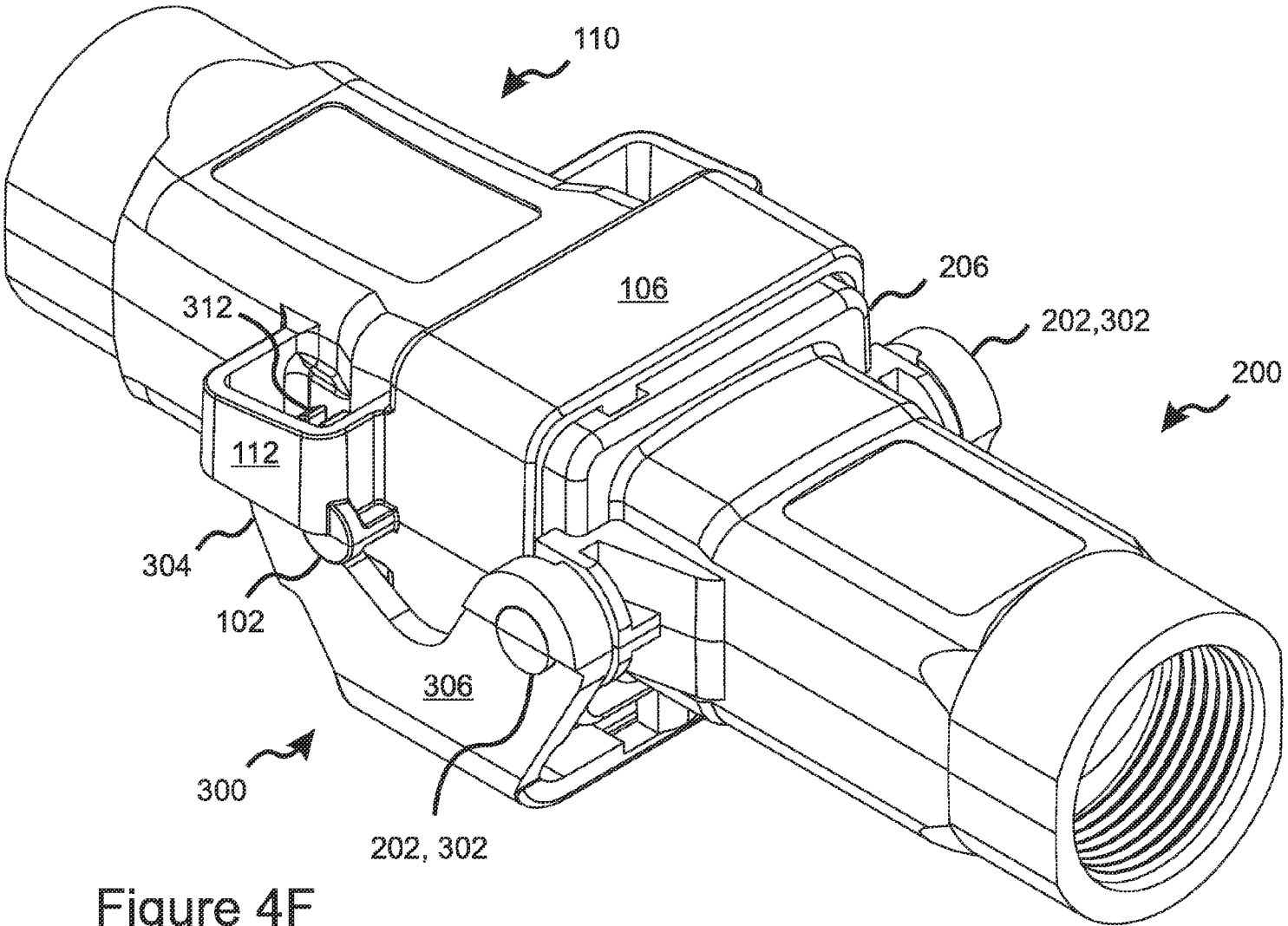
FIG. 4F is a reverse perspective view of the assembly of FIG. 4E.

FIG. 4E is a perspective illustration of the plug housing 110 of FIG. 1I, the receptacle housing 200 of FIG. 2A, and the latch mechanism 300 of FIG. 3A, all assembled and latched together as a unit. The assembled embodiment of FIG. 4E is shown in a reverse perspective view in FIG. 4F. It can be seen in FIGS. 4E and 4F that the protective latching barriers 112 extend around the latching regions where the latch hooks 304 engage with the latch posts 102 and the catches 312 engage with the catch tabs 104, thereby making it all but impossible to release the catches 312 from the catch tabs 104 without use of a suitable tool to circumvent the protective latching barriers 112.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

The invention claimed is:

1. A connector housing system, comprising:

a receptacle housing having a receptacle shell and being configured for housing at least one electrical contact;

a plug housing having a plug shell, the plug housing being adapted for housing at least one electrical contact and for mating with the receptacle housing in a mating direction, the plug shell being adapted for overlapping the receptacle shell when the plug housing is mated with the receptacle housing, the overlapping shells thereby forming a barrier which inhibits penetration of water and debris to the electrical contacts;

a pair of latch pivots extending outward in opposing directions from one of the receptacle housing and the plug housing, the latch pivots extending along an axis perpendicular to the mating direction;

a pair of latch posts extending outward in opposing directions from the other of the receptacle housing and the plug housing and configured so as to be aligned with the latch pivots when the receptacle housing is mated with the plug housing;

a latch mechanism having a pair of opposing pivot holes and a pair of opposing latch hooks, the pair of opposing pivot holes being rotatably mountable on the pair of latch pivots so as to enable the latch mechanism to rotate between a latched orientation and an open orientation, the latch hooks being configured for hooking attachment to the latch posts when the latch is in the latched orientation, the latch being configured so as to cover at least a portion of the overlapping shells of the receptacle housing and the plug housing and inhibit entry therein of debris and water when the latch mechanism is in the latched orientation;

a pair of catch tabs proximal to the pair of latch posts; and a pair of catches proximal to the pair of latch hooks and adapted to automatically engage with the catch tabs when the latch mechanism is in the latched orientation, release of the catches from the catch tabs being required before the latch mechanism can be rotated from the latched orientation to the open orientation, whereby the catches can be released from the catch tabs only by use of a tool, and not by an unaided hand.

2. The connector housing system of claim 1, further comprising a latch retaining mechanism configured so as to automatically capture the latch mechanism when the latch mechanism is rotated to the open orientation, and to retain the latch mechanism in the open orientation against gravitational disengagement until the latch is dislodged therefrom by an externally applied force.

3. The connector housing system of claim 2, wherein the latch retaining mechanism includes a retaining stop which protrudes from the plug housing and a retaining flap which extends from the latch, the retaining stop and the retaining flap being configured so as to cause the retaining flap to engage with the retaining stop when the latch mechanism is attached to the latch pivots and rotated to the open orientation.

4. The connector housing system of claim 1, wherein the catches can be released from the catch tabs by use of a screwdriver.

5. The connector housing system of claim 1, wherein at least one of the receptacle housing and the plug housing includes at least one permanently mounted electrical contact.

6. The connector housing system of claim 1, wherein at least one of the receptacle housing and the plug housing is configured to accept at least one insertable electrical contact.

7. The connector housing system of claim 1, wherein the catches are attached to the latch mechanism by living hinges.

8. The connector housing system of claim 7, further comprising a pair of catch stops adapted for limiting the ranges of movement of the living hinges.

9. The connector housing system of claim 1, wherein the pair of opposing pivot holes of the latch mechanism is mountable on the pair of latch pivots and on the pair of latch posts, the latch hooks can be engaged with either of the pair of latch pivots and the pair of latch posts, and a pair of catch tabs is provided on each of the plug housing and the receptacle housing, thereby enabling the latch mechanism to be attached to either of the receptacle housing and the plug housing and hooked to the other of the receptacle housing and the plug housing, according to a preference of a user of the connector housing system.

10. The connector housing system of claim 9, wherein a latch retaining mechanism is able to retain the latch in the open orientation when the latch is attached to the receptacle housing, and a latch retaining mechanism is able to retain the latch in the open orientation when the latch is attached to the plug housing.

11. The connector housing system of claim 1, wherein at least one of the receptacle housing and the plug housing is configured for mounting to a threaded conduit.

12. The connector housing system of claim 1, wherein at least one element of the connector housing system is made from plastic that is UL outdoor rated for ultraviolet exposure.

13. The connector housing system of claim 1, wherein at least one element of the connector housing system is constructed so as to pass a drop-test of 1 meter at minus 40 degrees C.

14. The connector housing system of claim 1, further comprising a pair of protective latching barriers which block direct access to the catches and the catch tabs when the catches are engaged with the catch tabs and the latch mechanism is in the latched orientation.

* * * * *